US007367654B2

(12) United States Patent
Togashi et al.

(10) Patent No.: US 7,367,654 B2
(45) Date of Patent: May 6, 2008

(54) LIQUID EJECTING APPARATUS AND LIQUID EJECTING METHOD

(75) Inventors: Takayuki Togashi, Nagano-Ken (JP); Tomoaki Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 411 days.

(21) Appl. No.: 11/019,540

(22) Filed: Dec. 23, 2004

(65) Prior Publication Data

US 2005/0206682 A1 Sep. 22, 2005

(30) Foreign Application Priority Data

Dec. 24, 2003 (JP) ..... 2003-427097
Dec. 24, 2003 (JP) ..... 2003-427306
Dec. 24, 2003 (JP) ..... 2003-427454

(51) Int. Cl.
*B41J 2/06* (2006.01)

(52) U.S. Cl. ..... 347/55; 347/54

(58) Field of Classification Search ..... 347/9, 347/54, 55, 103, 111, 112, 120, 123, 127, 347/128, 131, 141, 142; 399/271, 273, 290, 399/292, 293–295

See application file for complete search history.

(56) References Cited

U.S. PATENT DOCUMENTS 6,168,259 B1 * 1/2001 Capurso ..... 347/36

* cited by examiner

*Primary Examiner*—Juanita D. Stephens
(74) *Attorney, Agent, or Firm*—Sughrue Mion, PLLC

(57) ABSTRACT

The present apparatus includes: a liquid ejecting head having a nozzle plate with an ejecting hole through which a liquid is discharged, a conductive member disposed behind an object being processed opposite to the liquid ejecting head, a potential difference generating device for generating a potential difference between the nozzle plate and the conductive member, and a switching control device for turning on and off the potential difference generating device. The switching control device decides whether a process to which the object is subjected is a borderless recording process that drops liquid drops on an edge part of the object or a bordered recording process that does not drop any liquid drops on the edge part, and turns off the potential difference generating device when the bordered recording process is executed.

56 Claims, 12 Drawing Sheets

LIQUID EJECTING APPARATUS AND LIQUID EJECTING METHOD

CROSS REFERENCE TO RELATED APPLICATIONS

This application is based upon and claims the benefit of priority from the prior Japanese Patent Application Nos. 2003-427097, 2003-427306 and 2003-427454, the entire contents of which are incorporated herein by reference.

BACKGROUND OF THE INVENTION

1. Field of the Invention

The present invention relates to a liquid ejecting apparatus and a liquid ejecting method in which liquid drops are ejected through an ejecting hole/holes formed in a liquid ejecting head onto an object to be processed.

2. Description of the Related Art

An ink-jet recording apparatus provided with an ink-jet recording head for image recording is a representative liquid ejecting apparatus. Other liquid ejecting apparatuses include an apparatus provided with a dye-ejecting head for manufacturing color filters for, for example, liquid crystal displays, an apparatus provided with an ejecting head for ejecting an electrode forming material (conductive paste) ejecting head for forming electrodes of organic EL displays and face emission displays (FEDs), an apparatus provided with a an ejecting head for ejecting a bioorganic substance to manufacture biochips and an apparatus provided with a sample-ejecting head serving as a precision pipette.

The ink-jet recording apparatus, namely, a representative liquid ejecting apparatus, generates comparatively low noise during a printing operation and is capable of forming small dots in a high dot density. Thus the ink-jet recording apparatus is used for various printing operations including a color-picture printing operations these days.

Generally, the ink-jet recording apparatus includes an ink-jet recording head mounted on a carriage capable reciprocating in directions along the width of a recording medium (an object to be processed), such as a recording paper sheet, namely, in a scanning direction and a direction opposite the scanning direction, a feed mechanism for feeding the recording medium in a direction perpendicular to the scanning direction, namely, a feed direction, and a platen supporting the recording medium that is fed by the feed mechanism to position the recording medium relative to the recording head.

In this ink-jet recording apparatus, the recording head is controlled according to printing data to jet ink drops onto the recording medium for printing. When the recording head mounted on the carriage is capable of jetting drops of, for example, black, yellow, cyan and magenta inks, the ink-jet recording apparatus is able to achieve full-color printing by using those color inks in proper discharge ratios as well as text printing using only the black ink.

There is an ink-jet recording apparatus of a type capable of selectively operating in either a borderless printing mode for printing the entire surface of a recording medium without leaving any margins or a bordered printing mode for printing part of the surface of a recording medium so as to leave unprinted margins on the peripheral portion of the recording medium.

When the ink-jet recording apparatus operates in a borderless printing mode, the ink-jet recording apparatus prints an area of a size larger than that of the recording medium to compensate for the positional displacement of the recording medium and the carriage.

Namely, when it is desired to print the recording medium without leaving any margins along the side edges, i.e., the edges extending in the feed direction, of the recording medium, the ink-jet recording apparatus is capable of setting the opposite ends of a scanning range in which the recording head moves for printing at positions outside the side edges of the recording medium to jet ink drops on areas outside the side edges of the recording medium.

Further, when it is desired to print the recording medium without leaving any margins along the leading and the trailing edges, i.e., the edges extending in the scanning direction, the ink-jet recording apparatus specifies a printing area extending beyond the leading edge of the recording medium and behind the trailing edge of the recording medium.

Ink drops jetted onto areas outside the recording medium are absorbed by an absorber, such as sponge, placed in a space behind the recording medium opposite to the recording head.

As mentioned above, ink drops are jetted on areas outside the leading and trailing edges and/or the side edges of the recording medium when it is desired to print the entire surface of the recording medium without leaving any margins along the edges of the recording medium. Consequently, ink mist flowed into a space behind the recording medium adheres to edge parts of the back surface of the recording medium to stain the recording medium with the ink. Such staining is a serious problem particularly when a recording medium is printed on both sides, or when printing a recording medium of which both sides are to be used, such as a postcard.

Moreover, the ink mist soils the interior of the ink-jet recording apparatus, sticks to the electric circuit and the linear scale to cause the electric circuit and the linear scale to malfunction, and deposits on the ink cartridge to dirty the user's hand.

Generally, a feed mechanism for feeding the recording medium is provided with feed rollers disposed opposite to each other to nip and feed the recording medium. One of the feed rollers opposite to each other is a drive roller formed by coating the circumference of a metal roller with an alumina coating formed by baking and having a frictional circumference and the other is a driven roller of a plastic material.

Generally, the recording medium fed into a recording zone is charged due to rubbing by the feed rollers when the recording medium is brought into contact with and is separated from the feed rollers, rubbing by the following recording medium when recording mediums are fed by an automatic sheet feeder or frictional contact of the recording medium with structural members on a feed passage. The charged recording medium tends to attract the ink mist to its back surface.

A method of solving such a problem employs a static eliminating means, such as a static elimination brush, to eliminate static charges from the charged recording medium. The static eliminating means is disposed necessarily at a position downstream the feed mechanism including the pair of feed rollers with respect to the feed direction and hence the printing zone is spaced a long distance apart from the feed mechanism. Consequently, the accuracy of feeding the recording medium is liable to be deteriorated and the recording medium tends to float unstably. The static elimination brush rubs the recording medium, such as a paper sheet, and produces paper powder. The thus produced paper powder adheres to the ejecting holes of the recording head and deteriorates the ink drop jetting ability of the recording head.

The size of ink drops to be jetted by the recording head is required to be reduced to meet the recent demand for higher print quality. Since the velocity of small ink drops decreases rapidly due to the viscous resistance of air, it is possible that ink drops jetted by the recording head toward areas outside the recording medium during an operation in the borderless printing mode are unable to reach the absorber so that ink mist is generated. The ink mist flowed into a space behind the recording medium adheres to edges parts of the back surface of the recording medium to stain the recording medium with the ink. Such staining is a serious problem particularly when the recording medium is printed on both sides, or when printing a recording medium of which both sides are to be printed, such as a postcard.

The necessity of an ink mist preventing means is great in order to prevent the conversion of ink drops jetted onto areas outside the recording medium into ink mist during an operation in the borderless printing mode. However, the operation in the bordered printing mode does not necessarily need the ink mist preventing means and it is possible that the ink mist preventing means employed for the operation in the borderless printing mode exerts a bad influence on the operation in the bordered printing mode.

In some cases, an ink drop jetted in some jetting mode fissions into a large main particle and a small satellite particle of a weight far smaller than that of the main particle. Even if the ink-jet recording apparatus is provided with a mist preventing means for preventing mist formation, the mist preventing means may be effective in preventing the large main particle from floating in a mist, but may be ineffective in preventing the small satellite particle of a weight far smaller than that of the main particle from floating in a mist.

Even in a state where an ink drop jetted toward a printing area in a recording medium can fission into a large main particle and a small satellite particle, the large main particle is able to reach the recording medium, while it is possible for the small satellite particle not to reach the recording medium and the small satellite particle forms a mist. Particularly, when a drop of a pigment ink fissions into a large main particle and a small satellite particle, there is a tendency that the small satellite particle is unable to reach the recording medium and form a mist.

The ink mist soils the interior of the ink-jet recording apparatus, sticks to the electric circuit and the linear scale to cause the electric circuit and the linear scale to malfunction, and deposits on the ink cartridge to dirty the user's hand.

Even if a small ink drop reaches the recording medium without forming a mist, the small ink drop is unable to fly stably and unable to impact on the recording medium at a desired position because the velocity of the small ink drop decreases rapidly. Consequently, it is possible that a blurred or rough picture is formed in a low print quality.

It may be possible to make sure that a small ink drop impacts on a recording medium at a desired position by jetting the small ink drop at a high initial velocity. However, the small ink drop is stretched and is caused to fission into a main particle and a satellite particle if the initial velocity of the ink drop is excessively high. If the ink-jet recording apparatus operates in an operating mode in which a satellite particle is liable to be produced, the main particle and the satellite particle fall at different positions, respectively, with respect to the scanning direction. Consequently, a laterally elongate dot is formed on the recording medium, and the laterally elongate dot reduces the sharpness in a printed image and deteriorates print quality. A problem causing change of color tone arises due to the union or separation of the main particle and the satellite particle resulting from differences in individual property, thermal environment and/or platen gap.

When an ink drop fissions into a main particle and a satellite particle, there is a tendency that the velocity of the main particle increases according to the increase of the initial velocity, whereas the velocity of the satellite particle does not increase according to the increase of the initial velocity. Thus the difference between the respective velocities of the main particle and the satellite particle increases and the distance between positions where the main particle and the satellite particle hit the recording medium, respectively, increases with the increase of the initial velocity, aggravating the problem relating to the deterioration of print quality and the change of color tone.

When the ink-jet recording apparatus is provided with some mist preventing means, the mist preventing means must continue to be effective from the start and the end of the printing operation.

SUMMARY OF THE INVENTION

The present invention has been made in view of the foregoing circumstances and it is therefore an object of the present invention to provide a liquid ejecting apparatus and a liquid ejecting method capable of surely preventing the conversion of liquid drops discharged by a liquid ejecting head into a mist.

An object of the present invention is to provide a liquid ejecting apparatus and a liquid ejecting method capable of selectively carrying out either of a bordered recording process and a borderless recording process and of surely preventing the conversion of liquid drops jetted by a liquid ejecting head into a mist in the borderless recording process without exerting a bad influence on the bordered recording process.

An object of the present invention is to provide a liquid ejecting apparatus and a liquid ejecting method capable of surely preventing the conversion of liquid drops discharged by a liquid ejecting head onto areas outside a recording medium in a borderless recording process into a mist.

An object of the present invention is to provide a liquid ejecting apparatus and a liquid ejecting method capable of making a small liquid drop impact on an object to be processed accurately at a desired position.

In order to achieve the above-mentioned objects, a liquid ejecting apparatus according to the present invention includes: a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole; a conductive member disposed in a space behind an object being processed opposite to the liquid ejecting head; potential difference generating means configured to generate a potential difference between the nozzle plate and the conductive member; and switching control means configured to control an operation of turning on and off the potential difference generating means, wherein the switching control means is configured to decide whether a process to which the object is subjected is a borderless recording process that applies liquid drops on an edge part of the object or a bordered recording process that does not drop any liquid drops on the edge part of the object so that the potential difference generating means is turned off when the bordered recording process is executed.

Preferably, the switching control means is configured to turn off the potential difference generating means only when the number of discharged liquid drops exceeds a predetermined number in the bordered recording process.

Preferably, the liquid ejecting apparatus further includes an absorbing member disposed in a space behind the object being processed and capable of absorbing liquid drops discharged through the ejecting holes toward a region outside the object. The conductive member forms the absorbing member, or is formed integrally with the absorbing member or disposed contiguously with the absorbing member.

Preferably, the liquid ejecting apparatus further includes a platen disposed opposite to the liquid ejecting head and supporting the object from behind the object to position the object relative to the liquid ejecting head. The absorbing member is mounted on the platen.

Preferably, the liquid ejecting apparatus further includes isolating means configured to hold the object being processed in an electrically isolated state.

In order to achieve the above-mentioned objects, the present invention is a liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, including: a process deciding step of deciding whether a process to which the object is subjected is a borderless recording process that applies liquid drops on an edge part of the object or a bordered recording process that does not drop any liquid drops on the edge part of the object; a switching control step of generating a potential difference between the nozzle plate and a conductive member disposed in a space behind the object opposite to the liquid ejecting head when the process deciding step decides that the process to which the object is subjected is the borderless recording process or not generating any potential difference between the nozzle plate and the conductive member when the process deciding step decides that the process to which the object is subjected is the bordered recording process; and a liquid drop discharging step of discharging liquid drops through the ejecting hole of the liquid ejecting head after the switching control step has controlled the potential difference between the nozzle plate and the conductive member.

Preferably, the switching control step does not generate any potential difference between the nozzle plate and the conductive member only when a number of discharged liquid drops in the bordered recording process exceeds a predetermined number.

In order to achieve the above-mentioned objects, a liquid ejecting apparatus according to the present invention includes: a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole; ejection control means configured to drive and control the liquid ejecting head so as to discharge a liquid drop of a properly selected size through the ejecting hole; a conductive member disposed in a space behind an object being processed opposite to the liquid ejecting head; and potential difference generating means configured to generate a potential difference between the nozzle plate and the conductive member. When liquid drops are discharged onto an edge part of the object and an area outside the edge part, the potential difference generating means generates the potential difference between the nozzle plate and the conductive member, and the discharge control means drives the liquid ejecting head so that liquid drops are discharged in a discharge mode in which a weight difference between a main particle of the liquid drop and a satellite particle of the liquid drop is small.

Preferably, the discharge control means is configured to control and drive the liquid ejecting head so that the liquid ejecting head discharges properly selected liquid drops of different sizes for forming dots of different sizes on the object. In the discharge mode in which the weight difference between the main particle and the satellite particle is small, liquid drops of sizes other than a largest size are discharged.

Preferably, in the discharge mode in which the weight difference between the main particle and the satellite particle is small, liquid drops of smallest size are discharged.

Preferably, the liquid ejecting apparatus further includes switching control means configured to control an operation of turning on and off the potential difference generating means. The switching control means turns off the potential difference generating means not to generate the potential difference between the nozzle plate and the conductive member except when liquid drops are discharged onto the edge part of the object and the area outside the edge part.

Preferably, the discharge control means selects the discharge mode in which the weight difference between the main particle and the satellite particle is small only when a number of discharged liquid drops exceeds a predetermined number.

Preferably, the liquid ejecting apparatus further includes an absorbing member disposed in a space behind the object being processed and capable of absorbing liquid drops discharged through the ejecting holes toward an area outside the object. The conductive member forms of the absorbing member, is formed integrally with the absorbing member or disposed contiguously with the absorbing member.

Preferably, the liquid ejecting apparatus further includes a platen disposed opposite to the liquid ejecting head and capable of supporting the object from behind the object to position the object relative to the liquid ejecting head. The absorbing member is combined with the platen.

Preferably, the liquid ejecting apparatus further includes isolating means configured to hold the object being processed in an electrically isolated state.

In order to achieve the above-mentioned objects, the present invention is a liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, wherein liquid drops are discharged by the liquid ejecting head in a discharge mode in which a weight difference between a main particle and a satellite particle is small in a state where a potential difference is generated between the nozzle plate and a conductive member disposed in a space behind the object being processed opposite to the liquid ejecting head when liquid drops are discharged onto an edge part of the object and an area outside the edge part.

Preferably, the liquid ejecting head is capable of discharging properly selected liquid drops of different sizes for forming dots of different sizes on the object. In the discharge mode in which the weight difference between the main particle and the satellite particle is small, liquid drops of sizes other than a largest size are discharged.

Preferably, in the discharge mode in which the weight difference between the main particle and the satellite particle is small, liquid drops of a smallest size are discharged.

Preferably, the potential difference is not generated between the nozzle plate and the conductive member except when liquid drops are discharged onto the edge part of the object and the area outside the edge part.

Preferably, liquid drops are discharged in the discharge mode in which the weight difference between the main particle and the satellite particle is small only when a number of discharged liquid drops exceeds a predetermined number.

In order to achieve the above-mentioned objects, a liquid ejecting apparatus according to the present invention includes: a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole; potential difference generating means configured to generate a potential difference between the nozzle plate and an object to be processed so as to exert a Coulomb force directed to the object on a charged liquid drop discharged through the ejecting hole; polarity inverting means configured to invert a polarity of voltage applied to the potential difference generating means to generate the potential difference between the nozzle plate and the object; and inverting control means configured to control the polarity inverting means so as to control timing of an inversion of the polarity of voltage.

Preferably, the inverting control means controls the polarity inverting means so that the polarity of voltage is inverted periodically at a fixed period.

Preferably, the liquid ejecting apparatus further includes a scanning mechanism configured to move the liquid ejecting head for scanning. The fixed period corresponds to one scanning cycle of a scanning operation to be performed by the liquid ejecting head moved by the scanning mechanism.

Preferably, the inverting control means controls the polarity inverting means so that the polarity of voltage is inverted when a number of discharged liquid drops discharged by the liquid ejecting head reaches a predetermined number.

Preferably, the polarity inverting means alternates positive and negative voltages with respect to a ground voltage for polarity inversion.

Preferably, the liquid ejecting apparatus further includes: isolating means configured to hold the object being processed in an electrically isolated state, and a conductive member disposed in a space behind the object being processed. The polarity inverting means inverts respective polarities of voltages applied respectively to the nozzle plate and the conductive member.

Preferably, the liquid ejecting apparatus further includes discharge control means configured to drive and control the liquid ejecting head so as to discharge a liquid drop of a properly selected size through the ejecting hole. The discharge control means drives and controls the liquid ejecting head to eject liquid drops in a discharge mode in which each liquid drop is able to fission into a main particle and a satellite particle.

Preferably, the satellite particle flies at a velocity unable to carry the satellite particle to a desired position on the object unless the Coulomb force is exerted on the satellite particle.

Preferably, the potential difference generating means applies a voltage across the object and the nozzle plate.

Preferably, the potential difference generating means includes charging means configured to charge the object.

Preferably, the charging means includes a corona discharger or a charging brush.

Preferably, the liquid ejecting apparatus further includes static eliminating means configured to eliminate static electricity from a processed part of the object.

Preferably, the static eliminating means has a static eliminating brush.

Preferably, the static eliminating brush is set in contact with a back surface of the object.

Preferably, the liquid ejecting apparatus further includes: isolating means configured to hold the object being processed in an electrically isolated state; and a conductive member disposed in a space behind the object being processed. The potential difference generating means applies a voltage across the nozzle plate and the conductive member.

Preferably, the isolating means includes insulating materials mounted at least on surfaces of members with which the object comes into contact.

Preferably, the conductive member is a conductive absorbing member capable of absorbing liquid drops.

Preferably, the conductive absorbing member is formed by subjecting a mixture of a nonconductive material and a conductive material to foam molding.

Preferably, the conductive absorbing member is formed by plating a nonconductive foamed member with a conductive material.

Preferably, the conductive absorbing member is formed by impregnating a nonconductive foamed member with an electrolyte.

Preferably, the electrolyte is ejected by the liquid ejecting head.

Preferably, the liquid ejecting apparatus further includes an absorbing member disposed in a space behind the object being processed and capable of absorbing liquid drops discharged through the ejecting hole. The conductive member is disposed contiguously with the absorbing member.

Preferably, the liquid ejecting apparatus further includes a platen disposed opposite to the liquid ejecting head and supporting the object from behind the object to position the object relative to the liquid ejecting head. The absorbing member is combined with the platen.

In order to achieve the above-mentioned objects, the present invention is a liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, including: a potential difference generating step of generating a potential difference between the nozzle palate and the object; and a liquid drop ejecting step of discharging charged liquid drops through the ejecting hole by driving the liquid ejecting head to process the object. A polarity of voltage for generating the potential difference between the nozzle plate and the object is inverted at a predetermined timing.

Preferably, the polarity of the voltage for generating the potential difference between the nozzle plate and the object is inverted periodically at a fixed period.

Preferably, the fixed period corresponds to one scanning cycle of a scanning operation to be performed by the liquid ejecting head moved by a scanning mechanism.

Preferably, the polarity of voltage for generating the potential difference between the nozzle plate and the object is inverted when a number of discharged liquid drops discharged by the liquid ejecting head reaches a predetermined number.

Preferably, the polarity of voltage for generating the potential difference between the nozzle plate and the object is inverted by alternating positive and negative voltages with respect to a ground voltage.

Preferably, the liquid ejecting head discharges liquid drops in a discharge mode in which each liquid drop is able to fission into a main particle and a satellite particle.

Preferably, the satellite particle flies at a velocity unable to carry the satellite particle to a desired position on the object unless a Coulomb force directed to the object is exerted on the satellite particle.

Preferably, a voltage is applied across the nozzle plate and the object.

Preferably, the object is charged by charging means.

Preferably, static electricity is eliminated from a processed part of the object by static eliminating means.

Preferably, the object being processed is held in an electrically isolated state. A voltage is applied across the nozzle plate and a conductive member disposed in a space behind the object being processed.

Preferably, the liquid ejecting method further includes a step of discharging liquid drops onto an absorbing member disposed in a space behind the object being processed and capable of absorbing liquid drops discharged through the ejecting holes prior to the potential difference generating step to use the absorbing member as a conductive member.

Preferably, respective polarities of the conducive member disposed in the space behind the object being processed and the nozzle plate are inverted.

The foregoing liquid ejecting apparatuses and the foregoing liquid ejecting methods according to the present invention are able to surely prevent the conversion of liquid drops discharged by the liquid ejecting head into mist.

The foregoing liquid ejecting apparatuses and the foregoing liquid ejecting methods according to the present invention are able to surely preventing the conversion of liquid drops discharged by the liquid ejecting head into mist in the borderless recording process without exerting a bad influence on the bordered recording process.

The foregoing liquid ejecting apparatuses and the foregoing liquid ejecting methods according to the present invention are able to surely prevent the conversion of liquid drops discharged by the liquid ejecting head toward the area outside the edge part of the object in the borderless recording process.

The foregoing liquid ejecting apparatuses and the foregoing liquid ejecting methods according to the present invention are able to able to surely making small liquid drops or satellite particles impact on the object at desired positions.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

An ink-jet recording apparatus and an ink-jet recording method embodying the present invention will be described hereunder.

An ink-jet recording apparatus according to the present invention is provided with an ink-jet recording head as a liquid ejecting head. The ink-jet recording head has ejecting holes, and pressure chambers connected respectively to the ejecting holes and is provided with pressure generating devices combined with the pressure chambers, respectively. The pressure generating device changes pressure applied to the ink contained in each pressure chamber to discharge an ink drop through the nozzle. The pressure generating devices may be, for example, piezoelectric vibrators.

Figure 1:
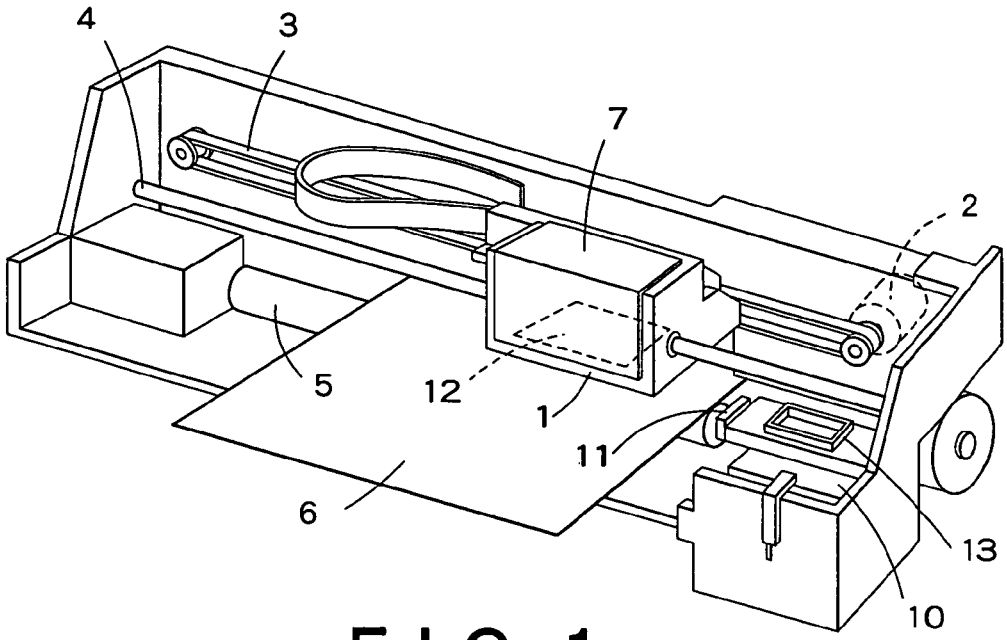
FIG. 1 is a schematic perspective view of an inkjet recording apparatus, namely, a liquid ejecting apparatus, in a preferred embodiment according to the present invention.
Figure 2:
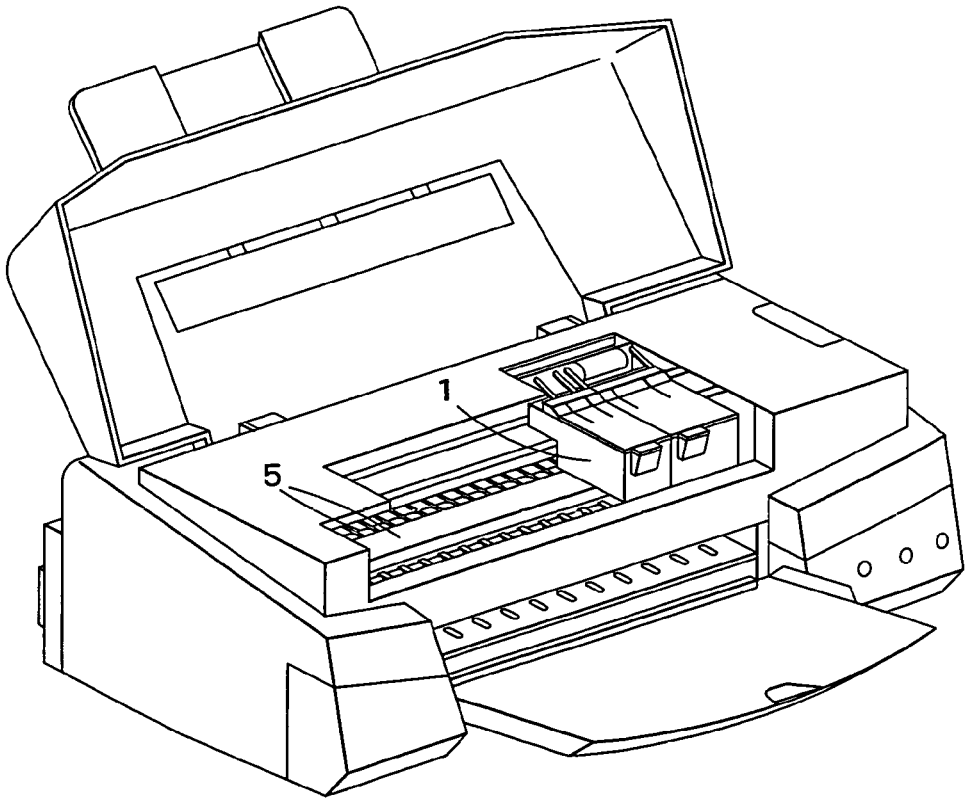
FIG. 2 is a schematic perspective view of the ink-jet recording apparatus, namely, a liquid ejecting apparatus, in the preferred embodiment according to the present invention.
Figure 3:
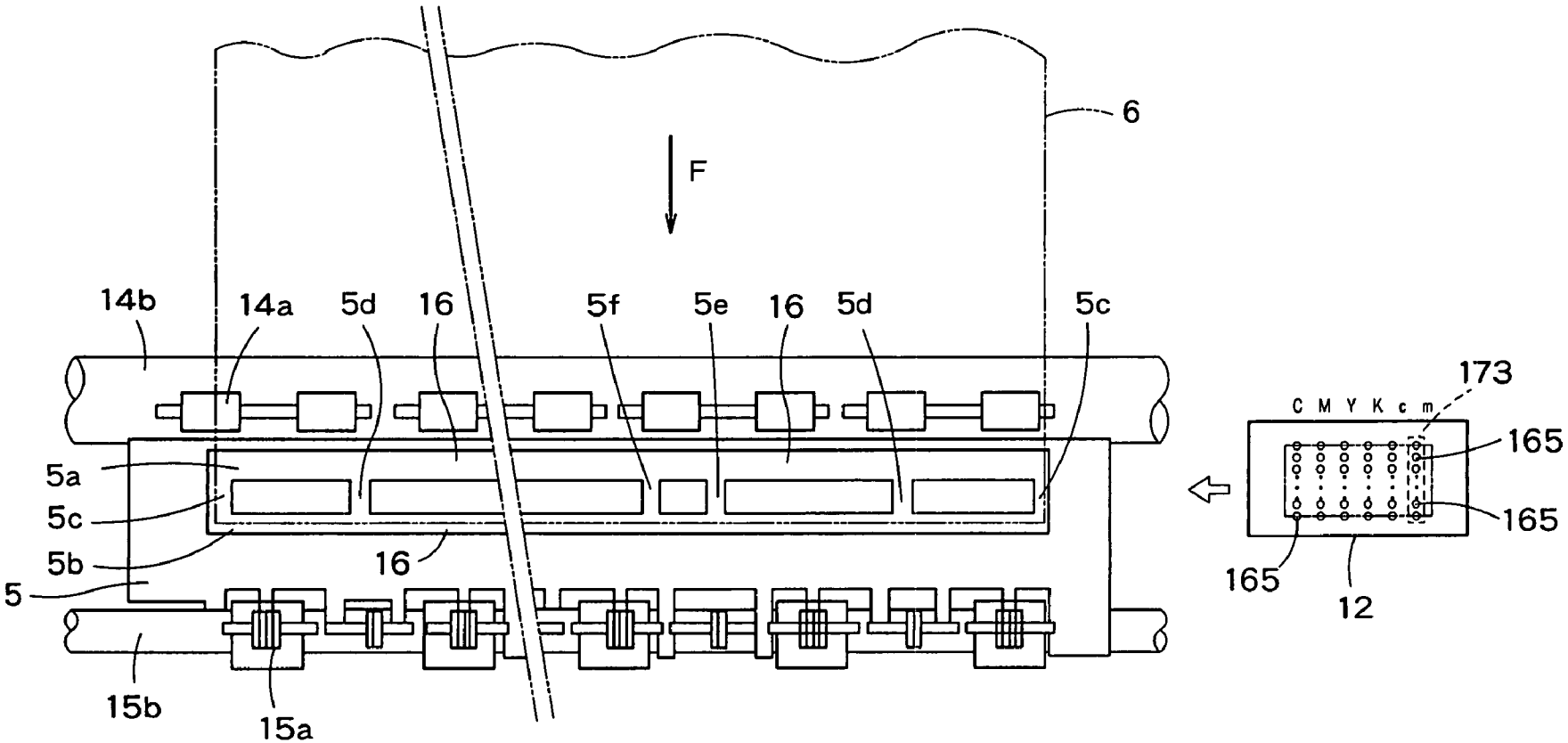
FIG. 3 is an enlarged view of a platen and components arranged around the platen of the ink-jet recording apparatus shown in FIGS. 1 and 2.

FIGS. 1 and 2 are schematic perspective views of an ink-jet recording apparatus in a preferred embodiment according to the present invention. FIG. 3 is an enlarged view of a platen and components arranged around the platen of the ink-jet recording apparatus. Referring to FIG. 1, a carriage 1 is guided by a guide member 4 for reciprocation along the axis of a platen 5. The carriage 1 is moved by a timing belt 3 driven by a carriage motor 2. The platen 5 supports a recording sheet 6 as an object to be processed, from behind the recording sheet 6 to position the recording sheet 6 relative to an ink-jet recording head (hereinafter, referred to simply as "recording head") 12.

The carriage 1, the carriage motor 2, the timing belt 3 and the guide member 4 constitute a scanning mechanism for moving the carriage 1 carrying the recording head 12 in a scanning direction.

The recording head 12 is provided with a plurality of ejecting holes 165 and a plurality of pressure chambers 173 connected to the ejecting holes 165, respectively. The recording head 12 is held on the carriage 1 so as to face the recording sheet 6. An ink cartridge 7 containing ink to be supplied to the recording head 12 is detachably attached to the carriage 1. The construction of the recording head 12 will be described later.

A cap 13 is disposed at the home position of the recording head 12 in a nonprinting region, namely, a right end region as viewed in FIG. 1. When the recording head 12 is returned to the home position, the cap 13 is pressed against a nozzle surface, in which the ejecting holes 165 open, of the recording head 12 so as to form a sealed space between the cap 13 and the ejecting holes of the recording head 12. A pump unit 10 is disposed under the cap 13. The pump unit 13 evacuates the sealed space formed by the cap 13 at a negative pressure.

A wiping device 11 provided with an elastic plate, such as a rubber plate, is disposed near the cap 13 on the side of a printing region with respect to the cap 13. For example, the wiping device 11 can be horizontally moved relative to a moving path along which the recording head 12 moves. When necessary, the wiping device 11 is able to wipe the holes forming surface of the recording head 12 when the carriage 1 reciprocates in a region around the cap 13.

The ink-jet recording apparatus is provided with a feed mechanism for intermittently feeding the recording sheet 6 in a direction perpendicular to the scanning direction. The recording sheet 6 is processed by a printing process carried out by the recording head 12.

Referring to FIG. 3, the feed mechanism includes feed rollers 14*a* and 14*b* disposed opposite to each other to nip and feed the recording sheet 6 onto the platen 5, and delivery rollers 15*a* and 15*b* disposed opposite to each other to deliver the printed recording sheet 6. The feed roller 14*a* and the delivery roller 15*a* are driven rollers, and the feed roller 14*b* and the delivery roller 15*b* are drive rollers.

As best shown in FIG. 3, the platen 5 is provided with a plurality of longitudinal ink receiving openings 5*c*, 5*d*, 5*e* and 5*f* parallel to a feed direction F in which the recording sheet 6 is fed, and a plurality of lateral ink receiving openings 5*a* and 5*b* extending in the scanning direction.

The positions of the pair of ink receiving openings 5*c* are determined so that the right and the left side edge of a recording sheet 6 of a size A3 move right over the ink receiving openings 5*c*, respectively. The positions of the pair of ink receiving openings 5*d* are determined so that the right and the left side edge of a recording sheet 6 of a size B4 move right over the ink receiving openings 5*d*, respectively. The positions of the pair of ink receiving openings 5*e* are determined so that the right and the left side edge of a recording sheet 6 of a size A4 move right over the ink receiving openings 5*e*, respectively. The positions of the pair of ink receiving openings 5*f* are determined so that the right and the left side edge of a recording sheet 6 of a size B5 move right over the ink receiving openings 5*f*, respectively.

The lateral ink receiving openings 5*a* and 5*b* are a feed-side ink receiving opening 5*a* and a delivery-side ink receiving opening 5*b*.

An absorbing member 16 capable of absorbing the ink discharged by the recording head 12 is placed in the ink receiving openings 5*a*, 5*b*, 5*c*, 5*d*, 53 and 5*f*.

Figure 4:
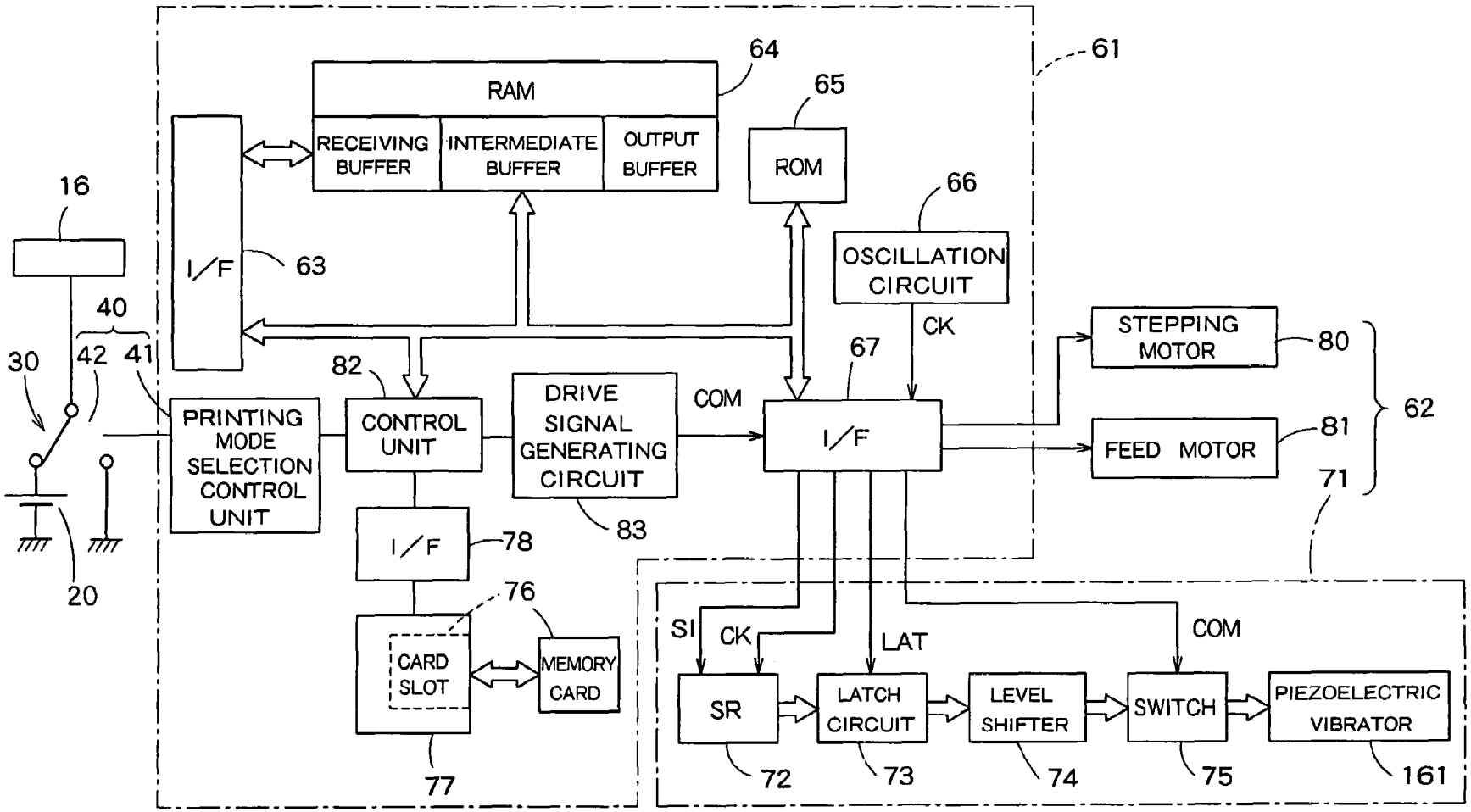
FIG. 4 is a functional block diagram of the ink-jet recording apparatus shown in FIG. 1.

Referring to FIG. 4 showing the ink-jet recording apparatus in a functional block diagram, the ink-jet recording apparatus has a printer controller 61 and a print engine 62. The printer controller 61 has an interface 63 that receives print data and the like from a host computer, not shown, a RAM 64 for storing data, a control unit 82, such as a CPU, an oscillation circuit 66, a drive signal generating circuit (drive signal generating means) 83 that generates drive signals, and an interface 67 that sends print data in the form of dot pattern data (bit map data) and drive signals to the print engine 62.

The printer controller 61 also has a card slot 77 capable of detachably holding a memory card, namely, a storage medium, and of serving as a storage medium holding device, and a card interface 78 capable of reading information recorded on the memory card 76 and of sending the information to the control unit 82. Possible storage mediums other than the memory card 76 are, for example, a floppy disk, a hard disk, a magnetic disk and the like.

The control unit 82 is a computer and controls an ink drop discharge operation on the basis of waveform data on the waveform of a drive signal stored in the memory card 76 and in accordance with control routines stored in a ROM 65.

The interface 63 receives, for example, character codes, and print data including one of a plurality of image data from the host computer. The interface 63 is able to send a busy signal BUSY and an acknowledge signal ACK to the host computer.

The RAM 64 is used as a receiving buffer, an intermediate buffer, an output buffer and a work memory, not shown. The receiving buffer stores temporarily print data received from the host computer. The intermediate buffer stores intermediate code data. The output buffer stores dot pattern data.

The ROM 65 stores control routines to be executed by the control unit 82, font data and graphic functions.

The ROM 65 also stores a fixed control routine (control program) which is not changed and is used perpetually. Data subject to version up, such as the data on the waveform of the drive signal, is stored in the memory card 76.

The control unit 82 controls the drive signal generating circuit 83 on the basis of data on the waveform of the drive signal read from the memory card 76 to generate a drive signal for a printing mode.

The print engine 62 has a stepping motor 80 for driving the recording head 12 for movement in the scanning direction, feed motor 81 for feeding a recording sheet, and an electric drive system for driving the recording head 12. The electric drive system 71 for driving the recording head 12 includes shift resisters 72, latch circuits 73, level shifters 74, switches 75 and piezoelectric vibrators 161. The control unit 82 and the drive signal generating circuit 83 constitute a recording head drive system (recording head drive means) for driving the piezoelectric vibrators 161 so as to change the pressure applied to the ink contained in the pressure chambers 173 to discharge ink drops through the ejecting holes 165 onto the recording sheet 6.

The control unit 82 may be a host computer directly connected to the recording apparatus or one of computers interconnected by a network.

The control unit 82 is capable of selecting either of a borderless printing mode in which the entire surface of the recording sheet 6 is printed without leaving any margins and a bordered printing mode in which a print area of the recording sheet 6 is printed leaving margins around the print area.

Figure 5:
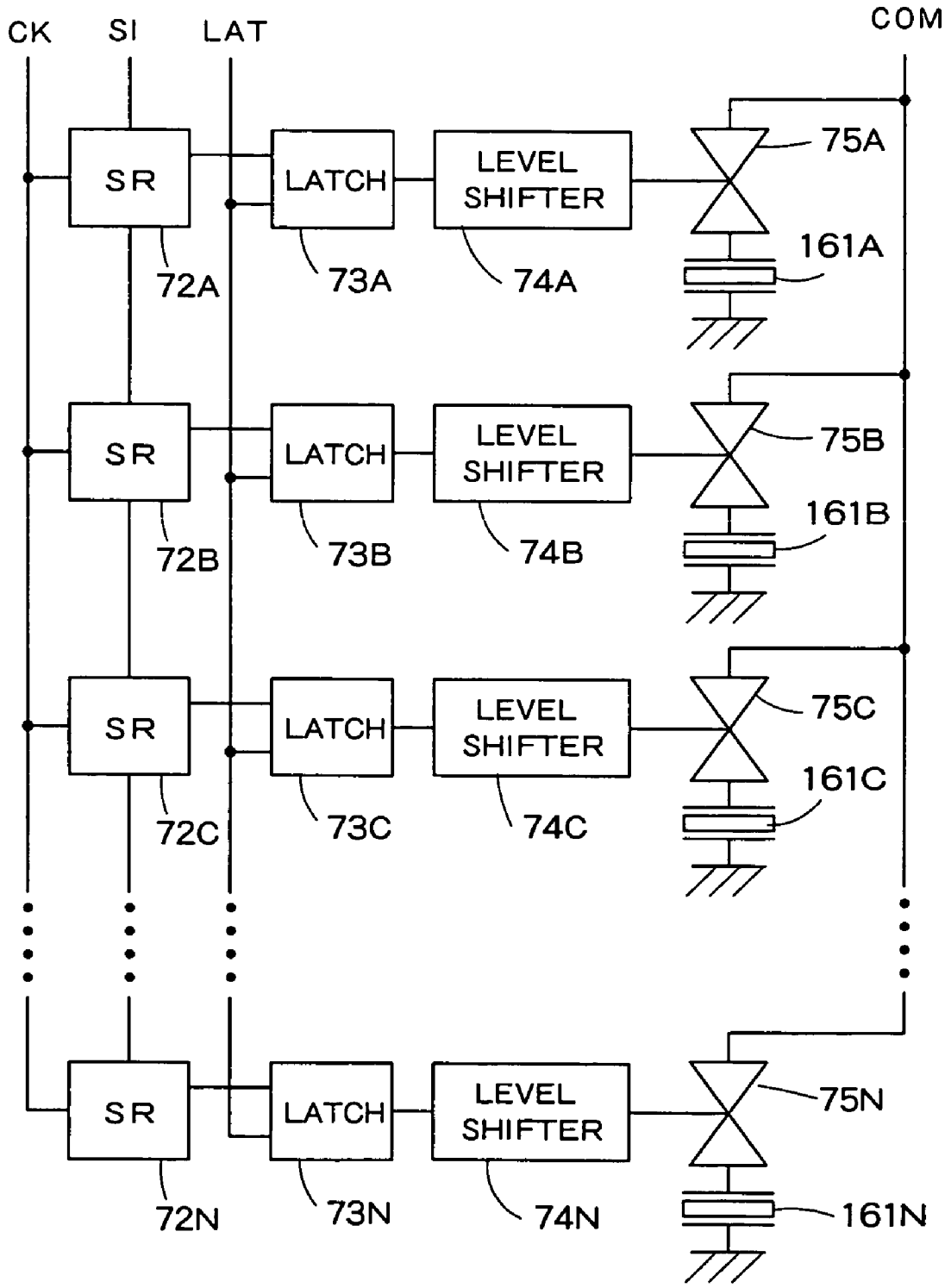
FIG. 5 is circuit diagram of a principal part of a recording head drive circuit included in the ink-jet recording apparatus shown in FIG. 1.

FIG. 5 shows a principal part of the recording head drive circuit for driving the recording head 12. The shift registers 72, the latch circuits 73, the level shifters 74, the switches 75 and the piezoelectric vibrators 161 shown in FIG. 4 are shift registers 72A to 72N, latch circuits 73A to 73N, level shifters 74A to 74N, the switches 75A to 75N and the piezoelectric vibrators 161A to 161N respectively for the ejecting holes 165 (FIG. 3) of the recording head 12. The switches 75A to 75N are analog switches. When data bit "1" is applied to the switches 75A to 75N, the drive signal is given directly to the piezoelectric vibrators 161A to 161N to vibrate the piezoelectric vibrators 161*a* to 161N according to the waveform of the drive signal. When a data bit "0" is applied to the switches 75A to 75N, the drive signal is not given to the piezoelectric vibrators 161A to 161N and the piezoelectric vibrators 161A to 161N hold charges charged thereon immediately before the interception of the drive signal.

Figure 6:
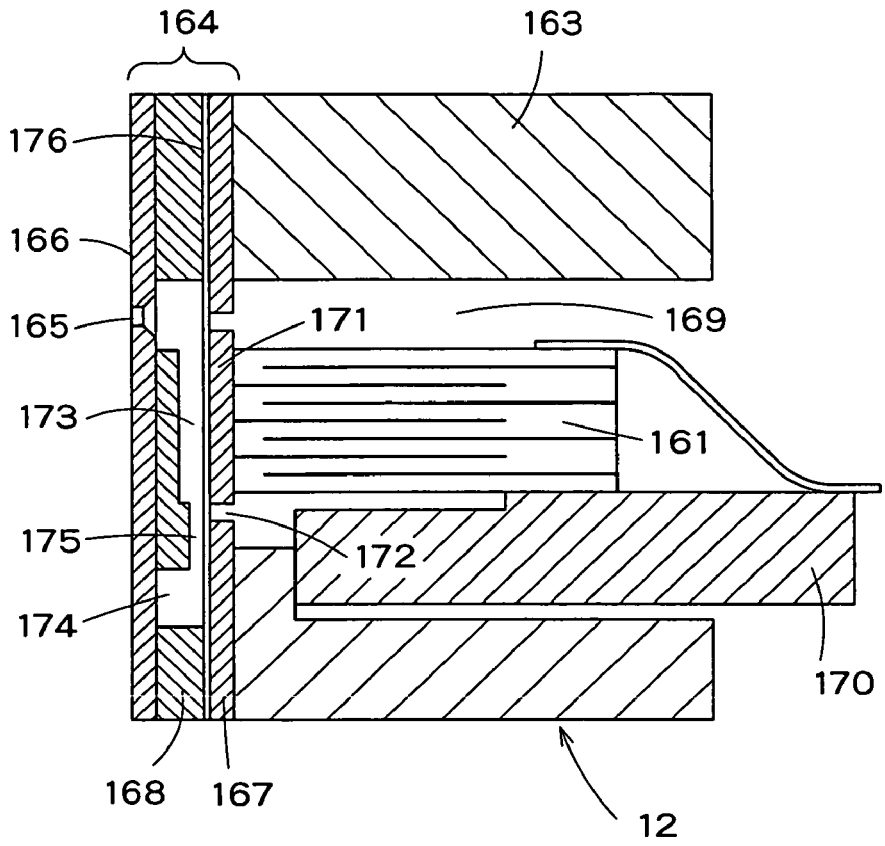
FIG. 6 is a sectional view of a recording head included in the ink-jet recording apparatus shown in FIG. 1.

FIG. 6 is a sectional view showing the construction of the recording head 12 included in the inkjet recording apparatus shown in FIG. 1.

The recording head 12 has a base 163 of a synthetic resin, and a passage unit 164 attached to the front surface (the left surface as viewed in FIG. 6) of the base 163. The passage unit 164 has a nozzle plate 166 provided with the ejecting holes 165, a vibrating plate 167, a passage plate 168 and a sheet 176.

The base 163 is a block provided with a holding space 169 extending through the block between the front and the back surface of the block. The piezoelectric vibrators 161 fixedly held on a fixed base plate 170 is held in the holding space 169.

The nozzle plate 166 is a thin plate provided with the ejecting holes 165 arranged in the feed direction. The ejecting holes 165 are arranged at pitches corresponding to a dot density. The vibrating plate 167 and the sheet 176 form thick islands 171 in contact with the piezoelectric vibrators 161 and thin, elastic parts 172 respectively surrounding the islands 171.

The islands 171 are arranged at predetermined pitches so as to correspond to the ejecting holes 165, respectively.

The passage plate 168 is provided with openings for forming the pressure chambers 173, a common ink chamber 174 and ink supply ports 175 by means of which the pressure chambers 173 communicate with the common ink chamber 174.

The nozzle plate 166 is disposed on the front side of the passage plate 168, and the vibrating plate 167 and the sheet 176 are disposed on the back side of the passage plate 168. The nozzle plate 166, the passage plate 168, and the vibrating plate 167 and the sheet 176 are adhesively bonded together to form the passage unit 164 as shown in FIG. 6.

In the passage unit 164, the pressure chambers 173 are formed behind the nozzle openings 165, and the islands 171 of the vibrating plate 167 are positioned behind the pressure chambers 173. The pressure chambers 173 communicate with the common ink chamber 174 by means of the ink supply ports 175.

The piezoelectric vibrators 161 are fixedly held on the base 163 with their tips attached to the back surfaces of the islands 171. Drive signals COMs and print data SI are given to the piezoelectric vibrators 161 through a flexible cable.

The piezoelectric vibrators 161 that operate in a longitudinal vibration mode contract in a direction perpendicular to an electric field when charged and extend in a direction perpendicular to the electric field when discharged. In this recording head 12, the piezoelectric vibrators 161 contract backward when charged to pull the islands 171 backward. Consequently, the contracted pressure chambers 173 are expanded and the ink flows from the common ink chamber 174 through the ink supply ports 175 into the pressure chambers 173. The piezoelectric vibrators 161 extend forward when discharged to push the islands 171 of the elastic plate forward. Consequently, the pressure chambers 173 contract and pressure applied to the ink contained in the pressure chambers 173 increases.

The absorbing member 16 incorporated into the platen 5 contains a conductive material. For example, the absorbing member 16 is a foamed member formed by foaming a mixture of a synthetic resin, such as a polyethylene resin or a polyurethane resin, and a conductive material, such as carbon. The absorbing member 16 may be formed by plating a body of a foamed polyethylene resin or a foamed polyurethane resin with a conducting material. The absorbing member 16 may be formed of a foamed polyethylene or polyurethane resin impregnated with an electrolyte containing ions, such as $Na^+$ ions, $K^+$ ions, $Cl^-$ ions or $HCO_3^-$ ions. The electrolyte may be an ink.

Figure 7:
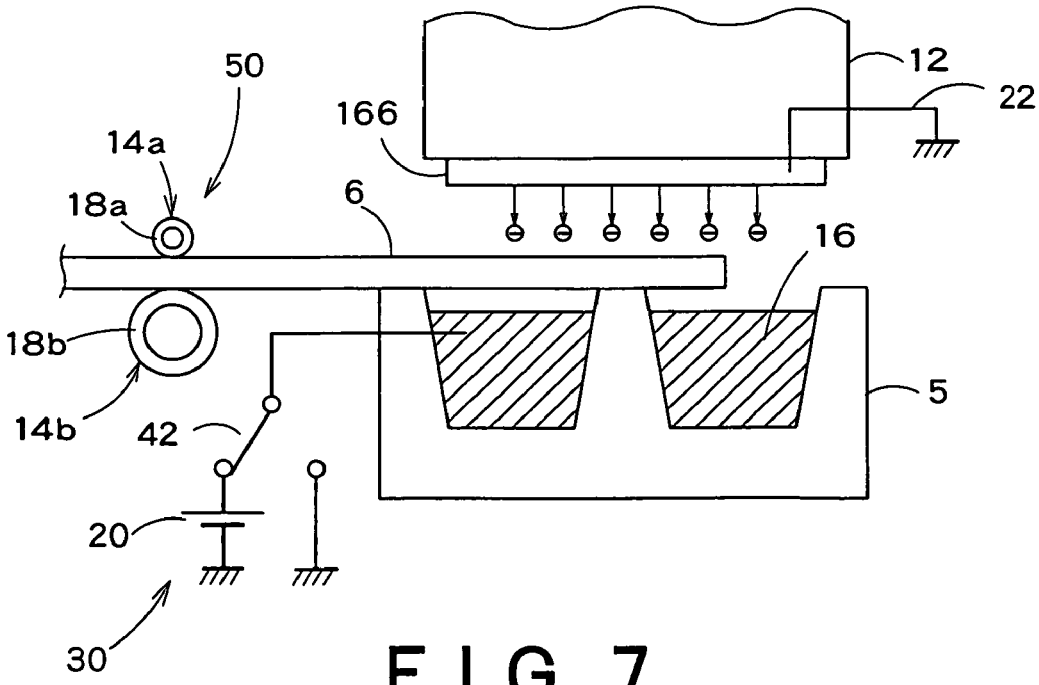
FIG. 7 is an enlarged sectional view of a potential difference generating device and the associated components included in the ink-jet recording apparatus shown in FIGS. 1 and 2.

As shown in FIG. 7, the ink-jet recording apparatus is provided with a potential difference generating device 30 including a power supply 20 and a switch 42. The absorbing member 16 is connected through the switch 42 to the positive terminal of the power supply 20, while the nozzle plate 166 is connected to a ground by a grounding wire 22. Thus the power supply 20 applies a positive voltage to the absorbing member 16 to generate a potential difference between the nozzle plate 166 and the absorbing member 16.

The ink-jet recording apparatus is provided with an isolating means 50 for holding the recording sheet 6 in an electrically isolated state during processing. More specifically, the isolating means 50 has, for example, insulating coatings 18*a* and 18*b* respectively coating at least the surfaces of the feed rollers 14*a* and 14*b* as shown in FIG. 7.

The isolating means 50 having the insulating coatings 18*a* and 18*b* holds the recording sheet 6 in an electrically isolated state during processing. Consequently, the recording sheet 6 acts as a dielectric member. Therefore, when the recording sheet 6 is inserted in a space between the nozzle plate 166 and the absorbing member 16, the lines of electric force are able to extend from the absorbing member 16 to the nozzle plate 166 without being intercepted by the recording sheet 6.

Figure 8:
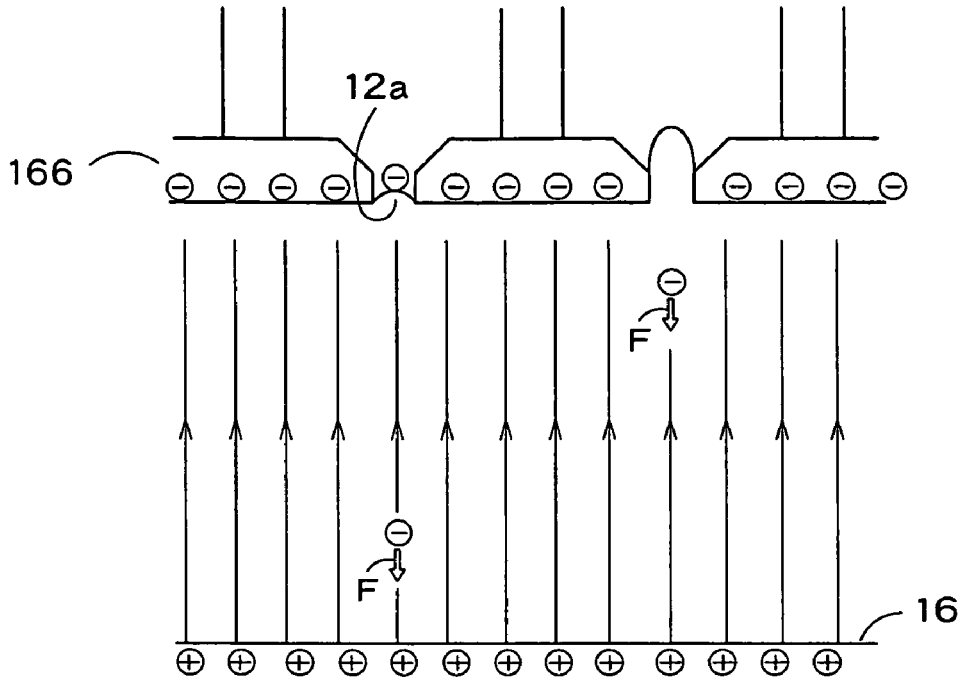
FIG. 8 is a diagrammatic view of lines of electric force generated by the potential difference generating device included in the ink-jet recording apparatus shown in FIGS. 1 and 2.

When the potential difference generating device 30 applies a positive voltage to the absorbing member 16 and grounds the nozzle plate 166, a positive charge is induced in the absorbing member 16 and a negative charge is induced in the nozzle plate 166 as shown in FIG. 8. Consequently, an electric field is created in a space between the absorbing member 16 and the nozzle plate 166. The direction of the electric field is indicated by the arrows in FIG. 8 and the electric field is represented by lines of electric force extending from the absorbing member 16 to the nozzle plate 166.

Since the negative charge is induced in the nozzle plate 166, a negative charge is induced in meniscoid parts of the ink filling the ejecting holes 165. The quantity of the electric charge can be readily calculated by using an expression for the parallel-plate capacitor. An ink drop discharged through the ejecting hole 165 is charged with a quantity of negative charge proportional to the sectional area of the ejecting hole 165. Then, the electric field created in the space between the absorbing member 16 and the nozzle plate 166 exerts a Coulomb force F acting in a direction toward the absorbing member 16 on the ink drop.

Ink drops discharged toward an area outside the recording sheet 6 for a recording operation in the borderless printing mode can surely impact on the absorbing member 16 and the conversion of the ink drops into a mist can be prevented.

The ink-jet recording apparatus will be described with reference to FIG. 4. The control unit 82 gives printing mode information about the selection of either the borderless printing mode or the bordered printing mode to a printing mode selection control unit 41 included in a printing mode selection control device 40. Referring to FIG. 7, the switch 42 of the potential difference generating device 30 makes the potential difference generating device operative by connecting the power supply 20 to the absorbing member 16 and makes the potential difference generating device 30 inoperative by disconnecting the power supply 20 from the absorbing member 16. The printing mode selection control unit 41 operates the switch 42 shown in FIG. 7 in accordance with the print mode information received from the control unit 82.

More specifically, the printing mode selection control device 40 decides whether the recording sheet 6 is to be printed in the borderless printing mode or the recording sheet 6 is to be printed in the bordered printing mode (printing mode deciding step). If the bordered printing mode is selected, the switch 42 is opened to make the potential difference generating device 30 inoperative. If the borderless printing mode is selected, the switch 42 is closed to make the potential difference generating device 30 operative (switching step).

The printing mode selection control device 40 is able to operate the switch 42 such that the switch 42 is opened to make the potential difference generating device 30 inoperative only when the number of the discharged ink drops exceeds a predetermined number in the printing operation in the bordered printing mode.

After the potential difference generating device 30 has been turned on or off in the switching step, the recording head 12 discharges ink drops (ink drop discharging step).

The ink-jet recording apparatus is capable of preventing the conversion of ink drops discharged by the recording head 12 into a mist without exerting a bad influence on the printing process in the bordered printing mode. If the printing operation in the bordered printing mode is performed with the potential difference generating device 30 turned on to create an electric field in the space between the nozzle plate 166 and the absorbing member 16, it is possible that paths of minute ink drops (secondary ink drops) discharge toward a peripheral part of a recording area on the recording sheet 6 are curved and the minute ink drops impact on margins, namely, nonrecording areas. Therefore, the ink-jet recording apparatus keeps the potential difference generating device 30 inoperative during the printing operation in the bordered printing mode to prevent minute ink drops impacting on margins on the recording sheet 6.

Figure 9:
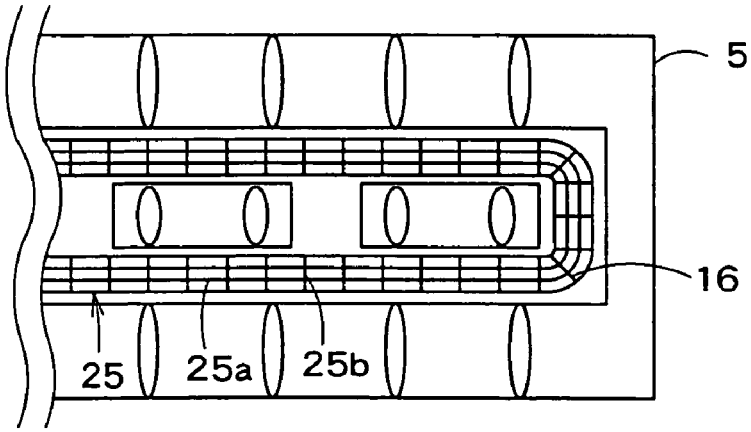
FIG. 9 is a plan view of a modification of the embodiment shown in FIG. 7.
Figure 10:
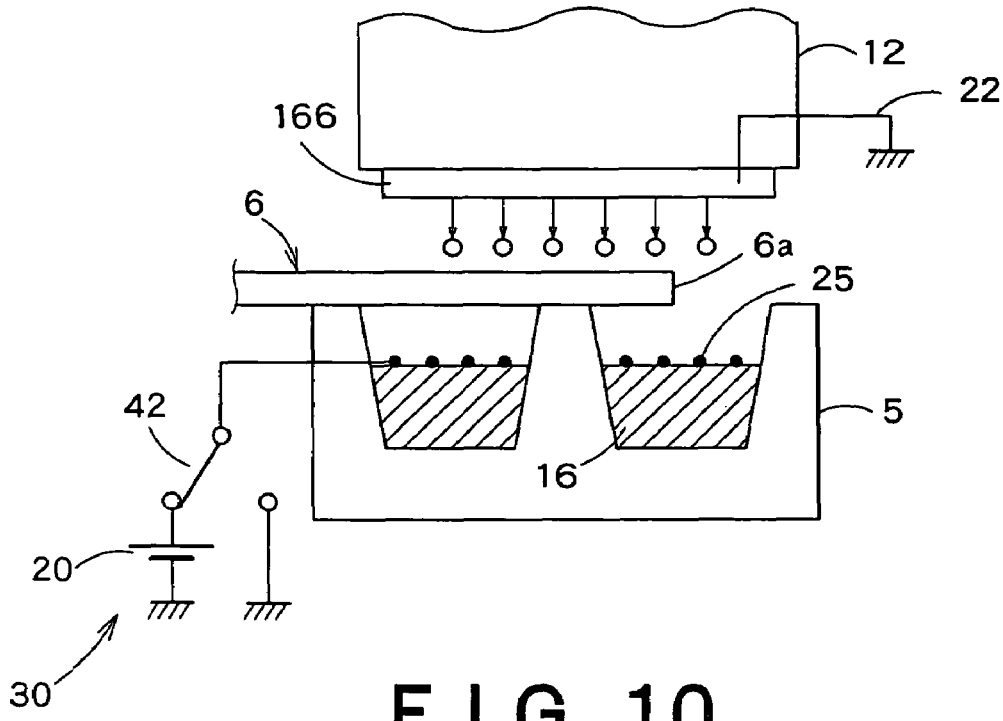
FIG. 10 is a vertical sectional view of the modification shown in FIG. 9.

FIGS. 9 and 10 show a modification of the foregoing embodiment. In this modification, a conductive grid 25 is disposed contiguously with the upper surface of an absorbing member 16 and a power supply 20 applies a positive voltage to the conductive grid 25. The conductive grid 25 has conductive parts 25*a* extending in the scanning direction and conductive parts 25*b* extending in the feed direction.

The absorbing member 16 in this modification does not need necessarily to be impregnated with a conductive substance and may be formed of, for example, sponge. The absorbing member 16 may be used in combination with a member formed of a conductive material. The member formed of a conductive material does not need to be a grid and may be a wire. The member formed of a conductive material may be disposed contiguously with the lower surface of the absorbing member 16 instead of contiguously with the upper surface of the absorbing member 16.

The potential difference generating device 30 in this modification is also provided with a switch 42 for making the potential difference generating device 30 operative or inoperative. The switch 42 of the potential difference generating device 30 is controlled for opening and closing by the printing mode selection control unit 41 operates the switch 42 shown in FIG. 4 in the aforesaid manner.

According to this modification, the same effect as that of the above-mentioned embodiment can be obtained.

Figure 11:
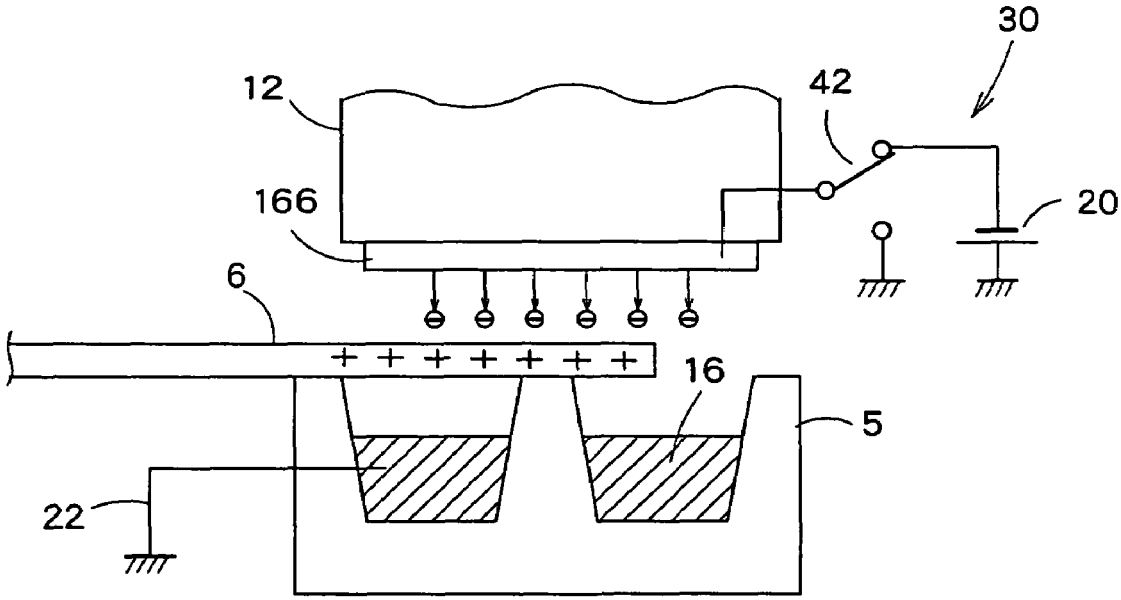
FIG. 11 is a plan view of another modification of the embodiment shown in FIG. 7.

Moreover, in the above-mentioned embodiment and modification, as shown in FIG. 11, the absorbing member 16 instead of the nozzle plate 166 may be connected to a ground by the grounding wire 22, and the power supply 20 may apply a negative voltage to the nozzle plate 166.

Further, in the foregoing potential difference generating devices 30, the direction of the electric field created between the nozzle plate 166 and the absorbing member 16 may be inverted; that is, the nozzle plate 166 may be charged at a positive potential and the absorbing member 16 may be charged at a negative potential.

An ink-jet recording apparatus and an ink-jet recording method in another embodiment according to the present invention will be described, in which the description of parts like or corresponding to those of the foregoing embodiment will be omitted and only parts different from those of the foregoing embodiment will be described.

Referring again to FIG. 4, in this embodiment, the control unit 82 gives printing mode information about the selection of either a borderless printing mode or a bordered printing mode and recording area information about an area to which ink drops are to be discharged to the printing mode selection control unit 41 included in the printing mode selection control device 40. As shown in FIG. 7, the potential difference generating device 30 is provided with the switch 42 for selectively making the potential difference generating device operative or inoperative. The printing mode selection control unit 41 operates the switch 42 shown in FIG. 7 in accordance with the print mode information received from the control unit 82.

More specifically, the printing mode selection control device 40 decides whether the recording sheet 6 is to be processed in a borderless processing mode or the recording sheet 6 is to be processed in a bordered processing mode. If the bordered processing mode is selected, the switch 42 is opened to make the potential difference generating device 30 inoperative.

If the borderless processing mode is selected and the area to which ink drops are to be discharged includes a peripheral part of the recording sheet 6 and an area outside the recording sheet 6, the switch 42 is closed to make the potential difference generating device 30 operative.

When the borderless processing mode is selected and the area to which ink drops are to be discharged includes a peripheral part of the recording sheet 6 and an area outside the recording sheet 6, the potential difference generating device 30 is made operative and the control unit 82 controls and drives the recording head 12 so that the recording head 12 discharges ink drops in a discharge mode in which the weight difference between a main particle and a satellite particle of each ink drop is small.

More specifically, the control unit 82 is capable of controlling and driving the recording head 12 such that the recording head 12 discharges properly selected ink drops of different sizes for forming dots of different sizes on the recording sheet 6. Ink drops of the sizes excluding the largest size are discharged in the discharge mode in which the weight difference between a main particle and a satellite particle is small. Preferably, liquid drops of the smallest size may be discharged in this discharge mode.

When the ink-jet recording apparatus in this embodiment operates in the borderless printing mode, ink drops discharged toward the absorbing member 16 lying outside the recording sheet 6 can be surely made to impact on the absorbing member 16 and the conversion of the ink drops into a mist can be surely prevented.

This effect will be explained. In some cases, when a discharged ink drop charged by the potential difference generating device 30 fissions into a main particle and a satellite particle, the main particle and the satellite particle have opposite polarities, respectively. In such a case, the polarity of the satellite particle is the same as that of the absorbing member 16 and hence the satellite particle cannot be attracted to the absorbing member 16 by the agency of the electric field.

In this embodiment, when ink drops are discharged onto an area including the entire surface of the recording sheet 6 and an area outside the recording sheet 6 in the borderless processing mode, the control unit 82 controls and drives the recording head 12 so that the weight difference between the main particle and the satellite particle of each ink drop is small to ensure that the conversion of the ink drops into a mist is prevented.

Moreover, in a modification of this embodiment, the printing mode selection control device 40 can close the switch 42 to make the potential difference generating device 30 operative when the bordered processing mode is selected. Further, when an area onto which ink drops are to be discharged in the borderless processing mode is other than edge parts of the recording sheet 6 and areas outside the edge parts, namely, a central part of an area to be printed, the switch 42 can be closed to make the potential difference generating device 30 operative.

In another modification, the conductive grid 25 may be disposed contiguously with the upper surface of the absorbing member 16 and the power supply 20 may apply a positive voltage to the conductive grid 25 as shown in FIGS. 9 and 10. The conductive grid 25 has the conductive parts 25*a* extending in the scanning direction and the conductive parts 25*b* extending in the feed direction.

The absorbing member 16 of the potential difference generating device 30 in this modification does not need necessarily to be impregnated with a conductive substance and may be formed of, for example, sponge. The absorbing member 16 may be used in combination with a member formed of a conductive material. Conductive wires may be used instead of the conductive grid 25. The member formed of a conductive material does not need to be a grid and may be a wire. The member formed of a conductive material may be disposed contiguously with the lower surface of the absorbing member 16 instead of contiguously with the upper surface of the absorbing member 16.

In this modification, if the borderless processing mode is selected and the area to which ink drops are to be discharged includes an edge part of the recording sheet 6 and an area outside the edge part, the potential difference generating device 30 is made operative and the control unit 82 controls the recording head 12 so that the recording head 12 discharges ink drops in a discharge mode in which the weight difference between a main particle and a satellite particle of each ink drop is small.

The effect of this modification is the same as that of the foregoing embodiment.

Moreover, in the foregoing embodiment and modifications, the absorbing member 16 may be grounded by the grounding wire 22 instead of grounding the nozzle plate 166 and the power supply 20 may apply a negative voltage to the nozzle plate 166 as shown in FIG. 11.

Further, in the foregoing embodiment and modifications, the direction of the electric field created by the potential difference generating device 30 may be inverted; that is, the nozzle plate 166 may be charged at a positive potential and the absorbing member 16 may be charged at a negative potential.

An ink-jet recording apparatus and an ink-jet recording method in still another embodiment according to the present invention will be described with reference to the accompanying drawings.

Figure 12:
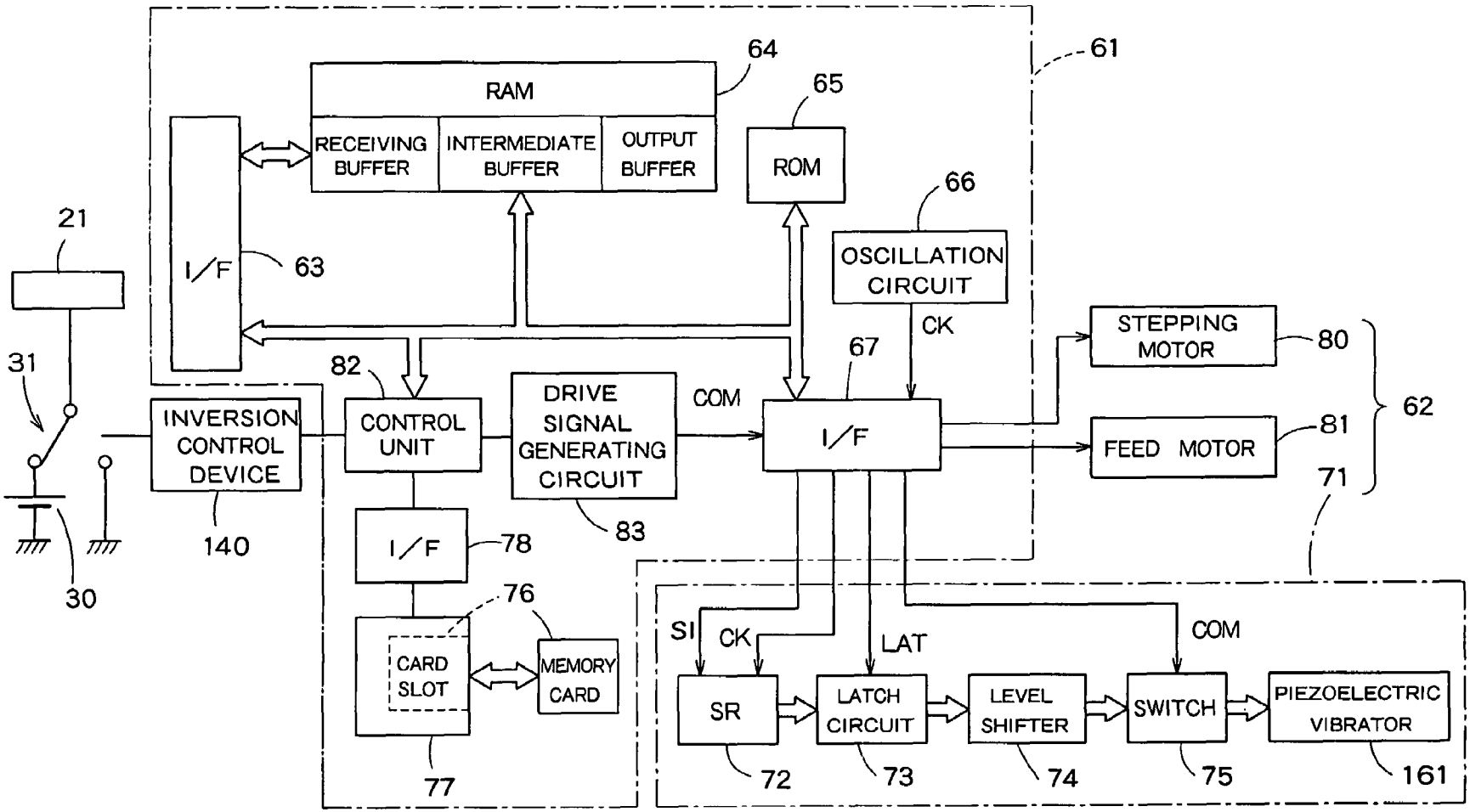
FIG. 12 is a functional block diagram of an ink-jet recording apparatus in another embodiment according to the present invention.

FIG. 12 is a functional block diagram of the ink-jet recording apparatus in this embodiment. The functional block diagram shown in FIG. 12 is substantially similar to that shown in FIG. 4, except that this embodiment has an inversion control device 140 and a polarity inverting device 31 operated by the inversion control device 140.

Figure 13:
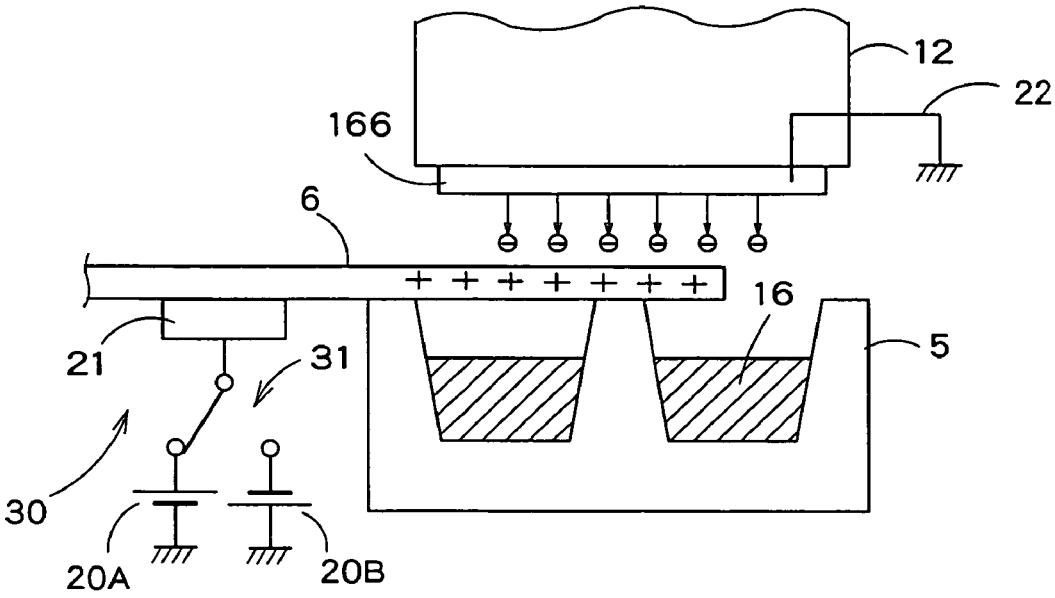
FIG. 13 is an enlarged sectional view of a potential difference generating device and the associated components included in the ink-jet recording apparatus shown in FIG. 12.

Referring to FIG. 13, the ink-jet recording apparatus in this embodiment has a potential difference generating device 30 including two power supplies 20A and 20B, a contact member 21 to be in contact with the back surface of the recording sheet 6 to apply the source voltage of the power supply 20A or 20B to the recording sheet 6, and a grounding wire 22 for grounding the nozzle plate 166. The respective polarities of the power supplies 20A and 20B with respect to a ground voltage are reverse to each other. The potential difference generating device 30 generates a potential difference between the nozzle plate 166 and the recording sheet 6.

Figure 14:
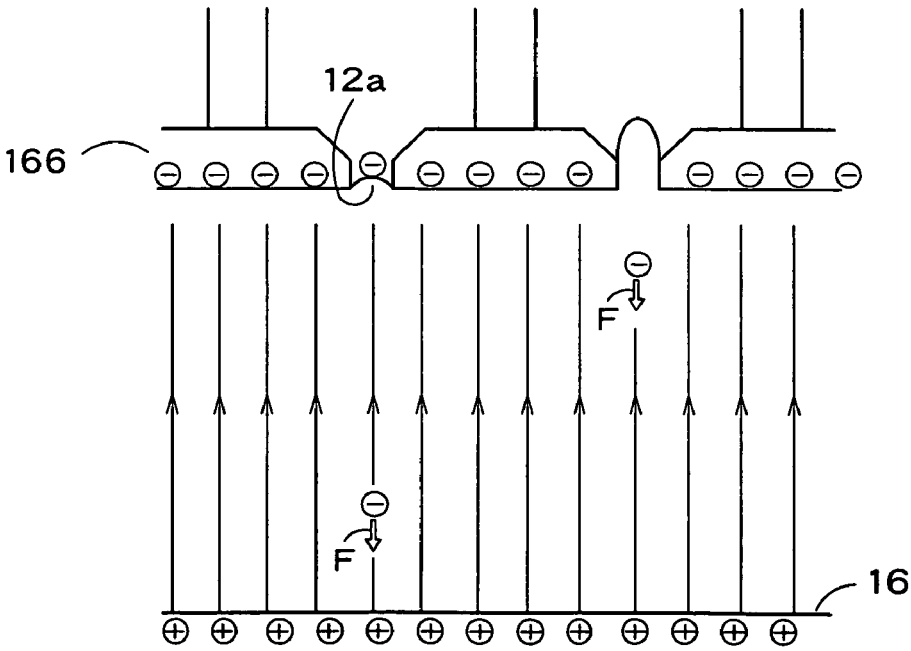
FIG. 14 is a diagrammatic view of lines of electric force generated by the potential difference generating device included in the ink-jet recording apparatus shown in FIG. 12.

The potential difference generating device 30 applies the voltage to the recording sheet 6, and the nozzle plate 166 is grounded. Consequently, a positive (or negative) charge is induced in the recording sheet and a negative (or positive) charge is induced in the nozzle plate 166 as shown in FIG. 14. Thus an electric field is created in a space between the recording sheet 6 and the nozzle plate 166 as shown in FIG. 14. The electric field is indicated by lines of electric force and the direction of the electric field is indicated by the arrows in FIG. 14.

Since the negative (or positive) charge is induced in the nozzle plate 166, a negative (or positive) charge is induced in meniscoid parts of the ink filling the ejecting holes 165. The quantity of the electric charge can be readily calculated by using an expression for the parallel-plate capacitor. An ink drop discharged through the ejecting hole 165 is charged with a quantity of negative (or positive) charge proportional to the sectional area of the ejecting hole 165. Then, the electric field created in the space between the recording sheet 6 and the nozzle plate 166 exerts a Coulomb force F acting in a direction toward the recording sheet 6 on the ink drop.

The recording head drive system including the control unit 82 and the drive signal generating circuit 83 is capable of controlling and driving the recording head so as to discharge ink drops in a discharge mode in which each ink drop is discharged so as to fission into a main particle and a satellite particle. The velocity of the satellite particle may be a low velocity at which the satellite particle is unable to impact on a desired position on the recording sheet 6 unless the Coulomb force F generated by the potential difference generating device 30 is exerted on the satellite particle.

The electric field created between the nozzle plate 166 and the recording sheet 6 exerts the Coulomb force F acting toward the recording sheet 6 on charged ink drops discharged through the ejecting holes 165. Consequently, the ink drops or satellite particles produced by the fission of the ink drops can surely reach the recording sheet 6, and hence any mist of satellite particles that cannot reach the recording sheet 6 will not be formed. Small ink drops or the satellite particles can be surely made to impact on the recording sheet 6 at desired positions and print quality can be improved.

This embodiment is provided with the polarity inverting device 31 for selectively connecting the power supply 20A or 20B to the contact member 21. The inversion control device 140 shown in FIG. 12 controls the polarity inverting device 31. The inversion control device 140 changes one of the power supplies 20A and 20B for the other at a predetermined timing. The inversion control device 140 operates the polarity inverting device 31 on the basis of information about printing condition received from the control unit 82. The information about printing condition given to the inversion control device 140 by the control unit 82 is, for example, information about the scanning pass of the recording head 12 or information about the number of ink drops discharged by the recording head 12.

A method of timing the change of one of the power supplies 20A and 20B for the other by the polarity inverting device 31 is, for example, a method of periodically changing the polarity of voltage at a fixed period. Preferably, the polarity of voltage is changed every completion of one cycle of the scanning operation of the recording head 12. The polarity of voltage may be inverted upon the increase of the number of ink drops discharged by the recording head 12 to a predetermined value.

In this embodiment, the polarity inverting device 31 operated by the inversion control device 140 inverts the polarity of the voltage generating a potential difference between the nozzle plate 166 and the recording sheet 6 at a predetermined timing. Thus the neutralization of the charge of the recording sheet 6 by the charged ink drops fallen on the recording sheet 6 and the resulting potential equalization of the nozzle plate 166 and the recording sheet 6 can be prevented.

If the polarity of the voltage for generating a potential difference between the nozzle plate 166 and the recording sheet 6 is fixed, there will be a potential difference between the nozzle plate 166 and the recording sheet 6 at an initial stage of the recording operation, but the potential of the recording sheet 6 will be neutralized by charged ink drops fallen on the recording sheet 6 during the first scanning cycle. Consequently, a sufficiently large potential difference cannot be maintained between the nozzle plate 166 and the recording sheet 6 and the electric field is unable to accelerate ink drops satisfactorily in the second and the following scanning cycles.

This embodiment thus inverts the polarity of the voltage for generating a potential difference between the nozzle plate 166 and the recording sheet 6 at a predetermined timing by the polarity inverting device 31. Therefore, the reduction of the effect of accelerating ink drops due to the neutralization of the potential of the recording sheet 6 can be prevented.

In the bordered printing mode, it is possible that the path of an ink drop, particularly, a satellite particle, is curved by Coulomb force generated by the charge of an ink drop previously fallen on the recording sheet 6 and the ink drop falls on a margin of the recording sheet 6. This embodiment is able to prevent the undesired staining of margins of the recording sheet 6 by periodically inverting the polarity of the voltage applied to the recording sheet 6.

Figure 15:
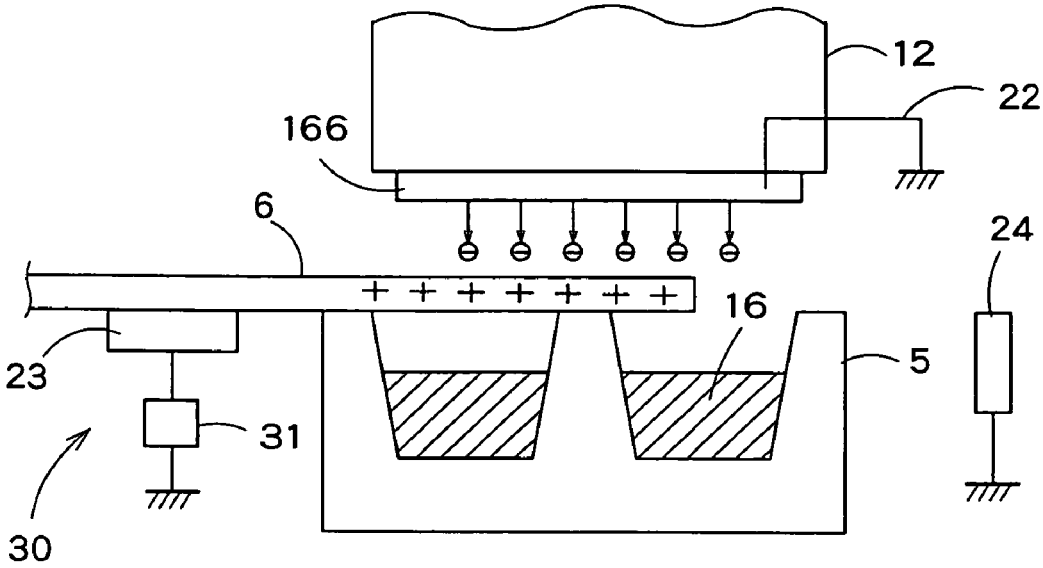
FIG. 15 is a sectional view of a modification of the embodiment shown in FIG. 13.

In a modification of this embodiment, the potential difference generating device 30 may include a charging device 23 for charging the recording sheet 6 as shown in FIG. 15. The charging device 23 is a corona discharger or a charging brush. The charging device 23 and a nozzle plate 166 are connected to the same ground. The charging device 23 charges the recording sheet 6 to generate a potential difference between the nozzle plate 166 and the recording sheet 6.

In this modification, a static eliminating device 24 is disposed at a position on the downstream side of the recording head 12 with respect to the feed direction in which the recording sheet 6 is fed to eliminate static electricity from processed part of the recording sheet 6. The static eliminating device 24 includes a static eliminating brush disposed so that the back surface of the recording sheet 6 come into contact with the static eliminating brush.

This modification, similarly to the embodiment shown in FIG. 13, is provided with the polarity inverting device 31. The polarity inverting device 31 alternates positive and negative charges of the recording sheet 6 at a predetermined timing for polarity inversion.

The effect of this modification is the same as that of the embodiment shown in FIG. 13. This modification also prevents the reduction of the ink drop accelerating effect due to the neutralization of the potential of the recording sheet 6.

Figure 16:
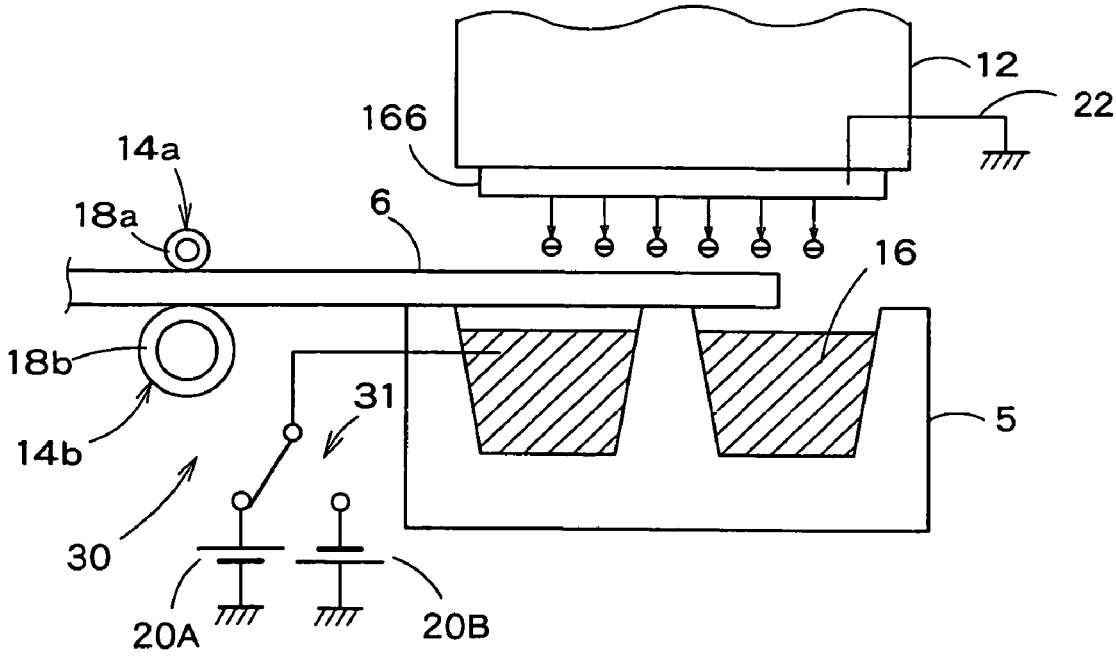
FIG. 16 is a plan view of another modification of the embodiment shown in FIG. 13.
Figure 17:
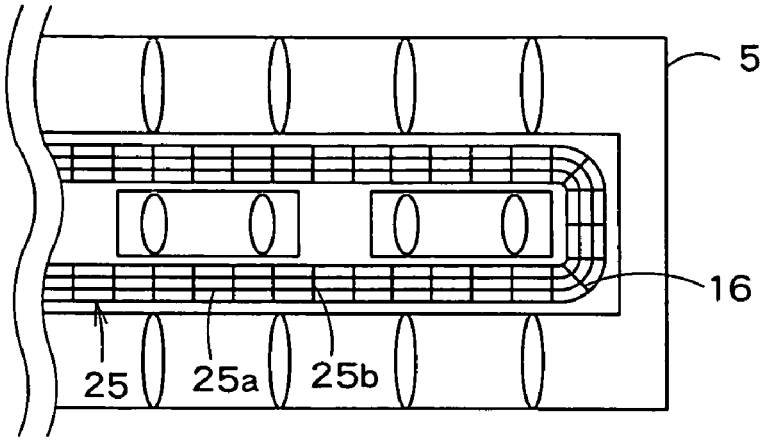
FIG. 17 is a plan view of another modification of the embodiment shown in FIG. 13.
Figure 18:
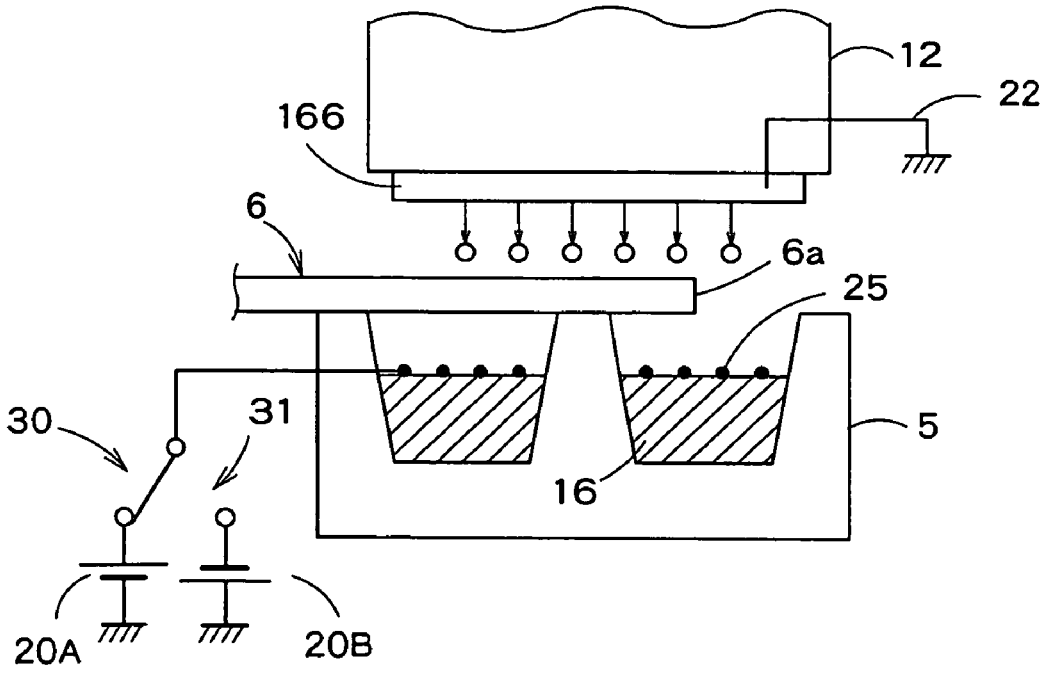
FIG. 18 is a sectional view of the example shown in FIG. 17.

FIG. 16 shows another modification of the foregoing embodiment.

In the modification shown in FIG. 16, the absorbing member 16 incorporated into the platen 5 is formed of a conductive material. The respective source voltages of the power supplies 20A and 20B are applied alternately to the absorbing member 16 to generate a potential difference between the nozzle plate 166 and the absorbing member 16.

This modification is provided with an isolating means for holding the recording sheet 6 in an electrically isolated state during processing. More specifically, the isolating means has the insulating coatings 18*a* and 18*b* respectively coating at least the surfaces of the feed rollers 14*a* and 14*b* as shown in FIG. 16.

The isolating means having the insulating coatings 18*a* and 18*b* holds the recording sheet 6 in an electrically isolated state during processing. Consequently, the recording sheet 6 acts as a dielectric member. Therefore, when the recording sheet 6 is inserted in a space between the nozzle plate 166 and the absorbing member 16, the lines of electric force are able to extend from the absorbing member 16 to the nozzle plate 166 without being intercepted by the recording sheet 6.

This modification, similarly to the embodiment shown in FIG. 13, is provided with the polarity inverting device 31. The polarity inverting device 31 inverts the polarity of voltage for generating a potential difference between the nozzle plate 166 and the contact member 21 at a predetermined timing.

This modification is the same as the embodiment shown in FIG. 13 in effect on preventing the reduction of the ink drop accelerating effect due to the neutralization of the recording sheet 6.

Although a voltage is applied to the conductive absorbing member 16 in the foregoing modification, the conductive grid 25 may be disposed contiguously with the upper surface of the absorbing member 16, and the power supplies 20A and 20B apply a voltage to the conductive grid 25. The conductive grid 25 has the conductive parts 25*a* extending in the scanning direction and the conductive parts 25*b* extending in the feed direction.

The absorbing member 16 in this modification does not need necessarily to be impregnated with a conductive substance and may be formed of, for example, sponge. The absorbing member 16 may be used in combination with a member formed of a conductive material. The member formed of a conductive material does not need to be a grid and may be a wire. The member formed of a conductive material may be disposed contiguously with the lower surface of the absorbing member 16 instead of contiguously with the upper surface of the absorbing member 16.

This modification is also provided with the polarity inverting device 31 the same as the example shown in FIG. 13, and the polarity inverting device 31 inverts a polarity of voltage which generates a potential difference between the nozzle plate 166 and the conductive grid 25 in accordance with the predetermined timing mentioned above.

According to this modification, the same effect as that of the example shown in FIG. 13 can be obtained. Namely, the reduction of the effect of accelerating ink drops due to the neutralization of the charge of the recording sheet 6 can be prevented.

Figure 19:
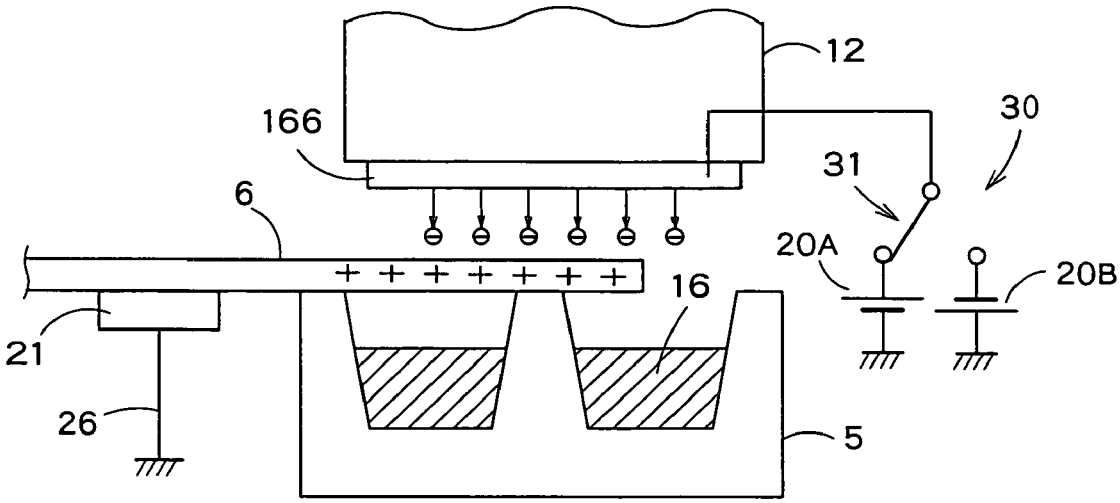
FIG. 19 is a sectional view of another modification of the embodiment shown in FIG. 13.

Moreover, in the aforementioned embodiment and modifications, the direction of the electric field generated by the potential difference generating device 30 may be inverted. Namely, as shown in FIG. 19, the recording sheet 6, not the nozzle plate 166, is grounded by a contact member 21 and a wiring 26, and a minus voltage applied to the nozzle plate 166 by the power supplies 20A and 20B.

This modification is also provided with the polarity inverting device 31 the same as the example shown in FIG. 13, and the polarity inverting device 31 inverts a polarity of voltage which generates a potential difference between the nozzle plate 166 and the contact member 21 in accordance with the predetermined timing mentioned above.

According to this modification, the same effect as that of the example shown in FIG. 13 can be obtained. Namely, the reduction of the effect of accelerating ink drops due to the neutralization of the charge of the recording sheet 6 can be prevented.

Figure 20:
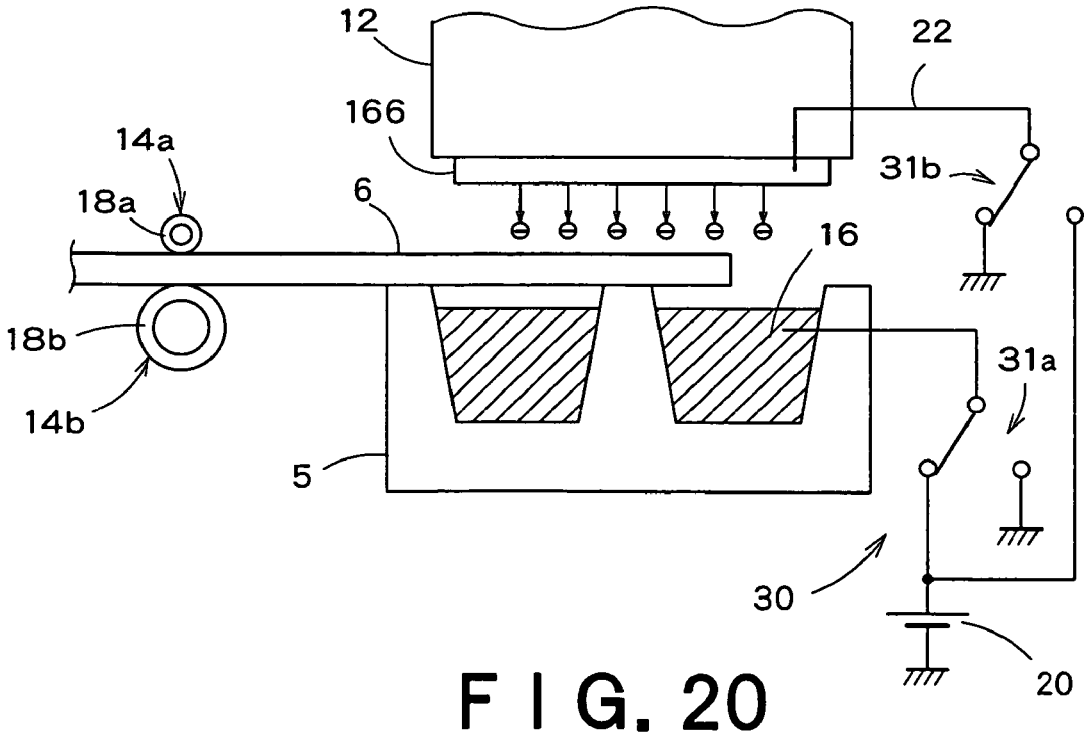
FIG. 20 is a sectional view of a modification of the example shown in FIG. 16.

FIG. 20 shows a modification of the example shown in FIG. 16. This modification shown in FIG. 20 is provided with polarity inverting devices 31*a* and 31*b* respectively connected to the nozzle plate 166 and the conductive absorbing member 16. The polarity of voltage for generating a potential difference between the nozzle plate 166 and the absorbing member 16 can be inverted at the predetermined timing by the polarity inverting devices 31*a* and 31*b*.

This modification exercises the same effect as that of the modification shown in FIG. 16, i.e., effect on preventing the reduction of ink drop accelerating effect due to the neutralization of the potential of the recording sheet 6, by using a single power supply 20. This capability of the modification is effective in reducing costs.

Although the invention has been specifically described in terms of the preferred embodiments thereof, obviously many changes and variations are possible therein. It is therefore to be understood that the present invention may be practiced otherwise than as specifically herein without departing from the scope and spirit thereof.

What is claimed is:

1. A liquid ejecting apparatus comprising:

a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole;

a conductive member disposed in a space behind an object being processed opposite to the liquid ejecting head;

potential difference generator configured to generate a potential difference between the nozzle plate and the conductive member; and switching controller configured to control an operation of turning on and off the potential difference generator, wherein the switching controller is configured to decide whether a process to which the object is subjected is a borderless recording process that applies liquid drops on an edge part of the object or a bordered recording process that does not drop any liquid drops on the edge part of the object so that the potential difference generator is turned off when the bordered recording process is executed.

2. The liquid ejecting apparatus according to claim 1, wherein the switching controller is configured to turn off the potential difference generator only when the number of discharged liquid drops exceeds a predetermined number in the bordered recording process.

3. The liquid ejecting apparatus according to claim 1 further comprising an absorbing member disposed in a space behind the object being processed and capable of absorbing liquid drops discharged through the ejecting holes toward a region outside the object;

wherein the conductive member forms the absorbing member, or is formed integrally with the absorbing member or disposed contiguously with the absorbing member.

4. The liquid ejecting apparatus according to 3 further comprising a platen disposed opposite to the liquid ejecting head and supporting the object from behind the object to position the object relative to the liquid ejecting head;

wherein the absorbing member is mounted on the platen.

5. The liquid ejecting apparatus according to claim 1 further comprising isolator configured to hold the object being processed in an electrically isolated state.

6. A liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, comprising:

a process deciding step of deciding whether a process to which the object is subjected is a borderless recording process that applies liquid drops on an edge part of the object or a bordered recording process that does not drop any liquid drops on the edge part of the object;

a switching control step of generating a potential difference between the nozzle plate and a conductive member disposed in a space behind the object opposite to the liquid ejecting head when the process deciding step decides that the process to which the object is subjected is the borderless recording process or not generating any potential difference between the nozzle plate and the conductive member when the process deciding step decides that the process to which the object is subjected is the bordered recording process; and a liquid drop discharging step of discharging liquid drops through the ejecting hole of the liquid ejecting head after the switching control step has controlled the potential difference between the nozzle plate and the conductive member.

7. The liquid ejecting method according to claim 6, wherein the switching control step does not generate any potential difference between the nozzle plate and the conductive member only when a number of discharged liquid drops in the bordered recording process exceeds a predetermined number.

8. A liquid ejecting apparatus comprising:

a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole;

ejection controller configured to drive and control the liquid ejecting head so as to discharge a liquid drop of a properly selected size through the ejecting hole;

a conductive member disposed in a space behind an object being processed opposite to the liquid ejecting head; and potential difference generator configured to generate a potential difference between the nozzle plate and the conductive member;

wherein, when liquid drops are discharged onto an edge part of the object and an area outside the edge part, the potential difference generator generates the potential difference between the nozzle plate and the conductive member, and the discharge controller drives the liquid ejecting head so that liquid drops are discharged in a discharge mode in which a weight difference between a main particle of the liquid drop and a satellite particle of the liquid drop is small.

9. The liquid ejecting apparatus according to claim 8, wherein the discharge controller is configured to control and drive the liquid ejecting head so that the liquid ejecting head discharges properly selected liquid drops of different sizes for forming dots of different sizes on the object, and wherein, in the discharge mode in which the weight difference between the main particle and the satellite particle is small, liquid drops of sizes other than a largest size are discharged.

10. The liquid ejecting apparatus according to claim 9, wherein, in the discharge mode in which the weight difference between the main particle and the satellite particle is small, liquid drops of smallest size are discharged.

11. The liquid ejecting apparatus according to claim 8, further comprising switching controller configured to control an operation of turning on and off the potential difference generator;

wherein the switching controller turns off the potential difference generator not to generate the potential difference between the nozzle plate and the conductive member except when liquid drops are discharged onto the edge part of the object and the area outside the edge part.

12. The liquid ejecting apparatus according to claim 8, wherein the discharge controller selects the discharge mode in which the weight difference between the main particle and the satellite particle is small only when a number of discharged liquid drops exceeds a predetermined number.

13. The liquid ejecting apparatus according to claim 8, further comprising an absorbing member disposed in a space behind the object being processed and capable of absorbing liquid drops discharged through the ejecting holes toward an area outside the object;

wherein the conductive member forms of the absorbing member, is formed integrally with the absorbing member or disposed contiguously with the absorbing member.

14. The liquid ejecting apparatus according to claim 13 further comprising a platen disposed opposite to the liquid ejecting head and capable of supporting the object from behind the object to position the object relative to the liquid ejecting head;

wherein the absorbing member is combined with the platen.

15. The liquid ejecting apparatus according to claim 8 further comprising isolator configured to hold the object being processed in an electrically isolated state.

16. A liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, wherein liquid drops are discharged by the liquid ejecting head in a discharge mode in which a weight difference between a main particle and a satellite particle is small in a state where a potential difference is generated between the nozzle plate and a conductive member disposed in a space behind the object being processed opposite to the liquid ejecting head when liquid drops are discharged onto an edge part of the object and an area outside the edge part.

17. The liquid ejecting method according to claim 16, wherein the liquid ejecting head is capable of discharging properly selected liquid drops of different sizes for forming dots of different sizes on the object, and wherein, in the discharge mode in which the weight difference between the main particle and the satellite particle is small, liquid drops of sizes other than a largest size are discharged.

18. The liquid ejecting apparatus according to claim 17, wherein, in the discharge mode in which the weight difference between the main particle and the satellite particle is small, liquid drops of a smallest size are discharged.

19. The liquid ejecting method according to claim 16, wherein the potential difference is not generated between the nozzle plate and the conductive member except when liquid drops are discharged onto the edge part of the object and the area outside the edge part.

20. The liquid ejecting method according to claim 16, wherein liquid drops are discharged in the discharge mode in which the weight difference between the main particle and the satellite particle is small only when a number of discharged liquid drops exceeds a predetermined number.

21. A liquid ejecting apparatus comprising:

a liquid ejecting head having a nozzle plate provided with an ejecting hole, the liquid ejecting head being configured to discharge liquid drops through the ejecting hole by changing pressure applied to a liquid contained in a pressure chamber connected to the ejecting hole;

potential difference generator configured to generate a potential difference between the nozzle plate and an object to be processed so as to exert a Coulomb force directed to the object on a charged liquid drop discharged through the ejecting hole;

polarity inverter configured to invert a polarity of voltage applied to the potential difference generator to generate the potential difference between the nozzle plate and the object; and inverting controller configured to control the polarity inverter so as to control timing of an inversion of the polarity of voltage.

22. The liquid ejecting apparatus according to claim 21, wherein the inverting controller controls the polarity inverter so that the polarity of voltage is inverted periodically at a fixed period.

23. The liquid ejecting apparatus according to claim 22 further comprising a scanning mechanism configured to move the liquid ejecting head for scanning;

wherein the fixed period corresponds to one scanning cycle of a scanning operation to be performed by the liquid ejecting head moved by the scanning mechanism.

24. The liquid ejecting apparatus according to claim 21, wherein the inverting controller controls the polarity inverter so that the polarity of voltage is inverted when a number of discharged liquid drops discharged by the liquid ejecting head reaches a predetermined number.

25. The liquid ejecting apparatus according to claim 21, wherein the polarity inverter alternates positive and negative voltages with respect to a ground voltage for polarity inversion.

26. The liquid ejecting apparatus according to claim 21 further comprising:

isolator configured to hold the object being processed in an electrically isolated state, and a conductive member disposed in a space behind the object being processed;

wherein the polarity inverter inverts respective polarities of voltages applied respectively to the nozzle plate and the conductive member.

27. The liquid ejecting apparatus according to claim 21 further comprising discharge controller configured to drive and control the liquid ejecting head so as to discharge a liquid drop of a properly selected size through the ejecting hole;

wherein the discharge controller drives and controls the liquid ejecting head to eject liquid drops in a discharge mode in which each liquid drop is able to fission into a main particle and a satellite particle.

28. The liquid ejecting apparatus according to claim 27, wherein the satellite particle flies at a velocity unable to carry the satellite particle to a desired position on the object unless the Coulomb force is exerted on the satellite particle.

29. The liquid ejecting apparatus according to claim 21, wherein the potential difference generator applies a voltage across the object and the nozzle plate.

30. The liquid ejecting apparatus according to claim 21, wherein the potential difference generator includes charger configured to charge the object.

31. The liquid ejecting apparatus according to claim 30, wherein the charger includes a corona discharger or a charging brush.

32. The liquid ejecting apparatus according to claim 30 further comprising static eliminator configured to eliminate static electricity from a processed part of the object.

33. The liquid ejecting apparatus according to claim 32, wherein the static eliminator has a static eliminating brush.

34. The liquid ejecting apparatus according to claim 33, wherein the static eliminating brush is set in contact with a back surface of the object.

35. The liquid ejecting apparatus according to claim 21 further comprising:

isolator configured to hold the object being processed in an electrically isolated state; and a conductive member disposed in a space behind the object being processed;

wherein the potential difference generator applies a voltage across the nozzle plate and the conductive member.

36. The liquid ejecting apparatus according to claim 35, wherein the isolator includes insulating materials mounted at least on surfaces of members with which the object comes into contact.

37. The liquid ejecting apparatus according to claim 35, wherein the conductive member is a conductive absorbing member capable of absorbing liquid drops.

38. The liquid ejecting apparatus according to claim 37, wherein the conductive absorbing member is formed by subjecting a mixture of a nonconductive material and a conductive material to foam molding.

39. The liquid ejecting apparatus according to claim 37, wherein the conductive absorbing member is formed by plating a nonconductive foamed member with a conductive material.

40. The liquid ejecting apparatus according to claim 37, wherein the conductive absorbing member is formed by impregnating a nonconductive foamed member with an electrolyte.

41. The liquid ejecting apparatus according to claim 40, wherein the electrolyte is ejected by the liquid ejecting head.

42. The liquid ejecting apparatus according to claim 37 further comprising a platen disposed opposite to the liquid ejecting head and supporting the object from behind the object to position the object relative to the liquid ejecting head;

wherein the absorbing member is combined with the platen.

43. The liquid ejecting apparatus according to claim 35 further comprising an absorbing member disposed in a space behind the object being processed and capable of absorbing liquid drops discharged through the ejecting hole;

wherein the conductive member is disposed contiguously with the absorbing member.

44. A liquid ejecting method of ejecting a liquid onto an object to be processed by a liquid ejecting head having a nozzle plate provided with an ejecting hole and capable of discharging liquid drops through the ejecting hole by changing pressure applied to a liquid contained in a pressure chamber connected to the ejecting hole, comprising:

a potential difference generating step of generating a potential difference between the nozzle palate and the object; and a liquid drop ejecting step of discharging charged liquid drops through the ejecting hole by driving the liquid ejecting head to process the object;

wherein a polarity of voltage for generating the potential difference between the nozzle plate and the object is inverted at a predetermined timing.

45. The liquid ejecting method according to claim 44, wherein the polarity of the voltage for generating the potential difference between the nozzle plate and the object is inverted periodically at a fixed period.

46. The liquid ejecting method according to claim 45, wherein the fixed period corresponds to one scanning cycle of a scanning operation to be performed by the liquid ejecting head moved by a scanning mechanism.

47. The liquid ejecting method according to claim 44, wherein the polarity of voltage for generating the potential difference between the nozzle plate and the object is inverted when a number of discharged liquid drops discharged by the liquid ejecting head reaches a predetermined number.

48. The liquid ejecting method according to claim 44, wherein the polarity of voltage for generating the potential difference between the nozzle plate and the object is inverted by alternating positive and negative voltages with respect to a ground voltage.

49. The liquid ejecting method according to claim 44, wherein the liquid ejecting head discharges liquid drops in a discharge mode in which each liquid drop is able to fission into a main particle and a satellite particle.

50. The liquid ejecting method according to claim 49, wherein the satellite particle flies at a velocity unable to carry the satellite particle to a desired position on the object unless a Coulomb force directed to the object is exerted on the satellite particle.

51. The liquid ejecting method according to claim 44, wherein a voltage is applied across the nozzle plate and the object.

52. The liquid ejecting method according to claim 44, wherein the object is charged by charging means.

53. The liquid ejecting method according to claim 52, wherein static electricity is eliminated from a processed part of the object by static eliminating means.

54. The liquid ejecting method according to claim 44, wherein the object being processed is held in an electrically isolated state, and wherein a voltage is applied across the nozzle plate and a conductive member disposed in a space behind the object being processed.

55. The liquid ejecting method according to claim 54 further comprising a step of discharging liquid drops onto an absorbing member disposed in a space behind the object being processed and capable of absorbing liquid drops discharged through the ejecting holes prior to the potential difference generating step to use the absorbing member as a conductive member.

56. The liquid ejecting apparatus according to claim 54, wherein respective polarities of the conducive member disposed in the space behind the object being processed and the nozzle plate are inverted.

* * * * *